US009245530B2

(12) United States Patent
Herre et al.

(10) Patent No.: US 9,245,530 B2
(45) Date of Patent: Jan. 26, 2016

(54) APPARATUS, METHOD AND COMPUTER PROGRAM FOR PROVIDING ONE OR MORE ADJUSTED PARAMETERS FOR PROVISION OF AN UPMIX SIGNAL REPRESENTATION ON THE BASIS OF A DOWNMIX SIGNAL REPRESENTATION AND A PARAMETRIC SIDE INFORMATION ASSOCIATED WITH THE DOWNMIX SIGNAL REPRESENTATION, USING AN AVERAGE VALUE

(75) Inventors: Juergen Herre, Buckenhof (DE); Cornelia Falch, Rum (AT); Leon Terentiv, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 763 days.

(21) Appl. No.: 13/446,747

(22) Filed: Apr. 13, 2012

(65) Prior Publication Data

US 2012/0263308 A1 Oct. 18, 2012

Related U.S. Application Data

(63) Continuation of application No. PCT/EP2010/065503, filed on Oct. 15, 2010.

(60) Provisional application No. 61/369,256, filed on Jul. 30, 2010, provisional application No. 61/252,298, filed on Oct. 16, 2009.

(30) Foreign Application Priority Data

Jul. 30, 2010 (EP) ..... 10171459

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ... G10L 19/008; G10L 19/20; H04S 2400/11; H04S 2420/07; H04S 7/30; H04S 2420/03; H04S 3/008; H04S 1/007; H04S 3/00; H04S 5/00; H04S 1/00; H04S 2400/01; H04S 5/005; H04S 2400/03; H04S 2420/01; H04S 2420/11; H04S 2420/13; H04S 3/004; H04S 7/00
USPC ..... 381/1, 17–23, 119, 61, 300; 700/94; 704/500, 501, 503, 200
See application file for complete search history.

(56) References Cited

U.S. PATENT DOCUMENTS 8,515,759 B2 8/2013 Engdegard et al.
8,634,577 B2 * 1/2014 Breebaart ..... 381/94.2

(Continued)

FOREIGN PATENT DOCUMENTS

CN 101411214 A 4/2009
CN 101529504 A 9/2009

(Continued)

OTHER PUBLICATIONS

Herre et al., "Technical Provisions for Limiting Perceptible Distortions in SAOC," Oct. 2009, 8 pages, Xi'an, China.*

(Continued)

*Primary Examiner* — Lun-See Lao
(74) *Attorney, Agent, or Firm* — Keating & Bennett, LLP

(57) ABSTRACT

An apparatus for providing one or more adjusted parameters for a provision of an upmix signal representation on the basis of a downmix signal representation and a parametric side information associated with the downmix signal representation has a parameter adjuster. The parameter adjuster is configured to receive one or more parameters and to provide, on the basis thereof, one or more adjusted parameters. The parameter adjuster is configured to provide the one or more adjusted parameters in dependence on an average value of a plurality of parameter values, such that a distortion of the upmix signal representation caused by the use of non-optimal parameters is reduced at least for parameters deviating from optimal parameters by more than a predetermined deviation.

22 Claims, 11 Drawing Sheets

(56) References Cited

U.S. PATENT DOCUMENTS

| | | | | |
|---|---|---|---|---|
| 2006/0115100 | A1* | 6/2006 | Faller | 381/119 |
| 2008/0199026 | A1* | 8/2008 | Oh et al. | 381/119 |
| 2008/0205671 | A1* | 8/2008 | Oh et al. | 381/119 |
| 2009/0110203 | A1 | 4/2009 | Taleb | |
| 2011/0013790 | A1 | 1/2011 | Hilpert et al. | |
| 2011/0022402 | A1 | 1/2011 | Engdegard et al. | |

FOREIGN PATENT DOCUMENTS

| | | | |
|---|---|---|---|
| KR | 10-2009-0057131 | A | 6/2009 |
| TW | 200713201 | A | 4/2007 |
| TW | 200910328 | A | 3/2009 |
| WO | 2008/084427 | A2 | 7/2008 |
| WO | 2008/100067 | A1 | 8/2008 |

OTHER PUBLICATIONS

Official Communication issued in International Patent Application No. PCT/EP2010/065503, mailed on Mar. 3, 2011.

Faller et al., "Binaural Cue Coding—Part II: Schemes and Applications," IEEE Transactions on Speech and Audio Processing, vol. 11, No. 6, Nov. 2003, pp. 520-531.

Faller, "Parametric Joint-Coding of Audio Sources," AES 120th Convention, Convention Paper 6752, May 20-23, 2006, pp. 1-12, Paris, France.

Herre et al., "From SAC to SAOC—Recent Developments in Parametric Coding of Spatial Audio," AES 22nd UK Conference, Apr. 2007, pp. 12-1 to 12-8.

Engdegard et al., "Spatial Audio Object Coding (SAOC)—The Upcoming MPEG Standard on Parametric Object Based Audio Coding," AES 124th Convention, Convention Paper, May 17-20, 2008, pp. 1-15, Amsterdam, The Netherlands.

"Information Technologies—MPEG Audio Technologies—Part 2: Spatial Audio Object Coding (SAOC)," ISO/IEC JTC 1/SC 29 N, Jul. 25, 2008,113 pages.

"Method, Apparatus and Computer Programs for Distortion Avoiding Audio Signal Processing," U.S. Appl. No. 61/173,456, 21 pages.

"Method for the Subjective Assessment of Intermediate Quality Level of Coding Systems," EBU Recommendation ITU-R BS.1534-1, (2001-2003),18 pages.

"ISO/IEC FCD 23003-2:200x, Spatial Audio Object Coding," ISO/IEC JTC 1/SC 29/WG 11, Jul. 2009, 114 pages, London, UK.

Official Communication issued in corresponding Taiwanese Patent Application No. 99135229 mailed on Mar. 24, 2014.

Official Communication issued in corresponding Korean Patent Application No. 10-2012-7011135, mailed on May 28, 2014.

Official Communication issued in corresponding Chinese Patent Application No. 201080052486.3, mailed on Sep. 9, 2013.

Official Communication issued in corresponding Canadian Patent Application No. 2,777.665, mailed on Feb. 24, 2014.

Official Communication issued in corresponding Japanese Patent Application No. 2012-533643, mailed on Jun. 4, 2013.

* cited by examiner

Parameter limiting schemas - (a) indirect and (b) direct control

FIG 5A

Table - Listening test conditions

| Coder name | Description |
|---|---|
| "DMX" | trivial downmix-similar rendering signal of the regular SAOC decoder |
| "noLim" | output of the regular (unprocessed by the PLS) SAOC decoder |
| "TC" | output of the SAOC decoder with TC direct control PLS |
| "R0" | output of the SAOC decoder with RC indirect control PLS |
| "R0_TC_1" | output of the SAOC decoder with combined TC/RC control PLS |

FIG 5B

Table - Audio items of the listening tests

| Listening items | Rendering type and matrix | Duration |
|---|---|---|
| "BlackCoffee" | soft horn section sound within the sound mix | 7 seconds |
| "Fanta4" | strong drum sound within the sound mix | 7 seconds |
| "LovePop" | soft string section sound within the sound mix | 7 seconds |
| "Audition" | soft music and strong vocal sound | 13 seconds |

Table - Tested extreme rendering conditions

| Listening items | Obj # | Audio object description | Rendering coefficient | |
|---|---|---|---|---|
| "BlackCoffee" | 1 | Brass 2 | 0.0001 | ~-80dB |
| | 2 | Brass 1 | 0.0001 | ~-80dB |
| | 3 | Organ | 3.1623 | ~10dB |
| | 4 | Drums&Bass | 3.1623 | ~10dB |
| | 5 | Percussion | 3.1623 | ~10dB |
| "Fanta4" | 1 | Vocals | 0.2512 | ~-12dB |
| | 2 | Bass | 0.2512 | ~-12dB |
| | 3 | Beat | 2.0 | ~6dB |
| "LovePop" | 1 | Drums | 2.5119 | ~8dB |
| | 2 | Bass | 2.5119 | ~8dB |
| | 3 | Electric Guitar | 2.5119 | ~8dB |
| | 4 | Acoustic Guitar | 2.5119 | ~8dB |
| | 5 | Strings | 0.0001 | ~-80dB |
| "Audition" | 1 | BG Vocals | 0.1778 | ~-15dB |
| | 2 | Bass | 0.1778 | ~-15dB |
| | 3 | Drums Reverb | 0.1778 | ~-15dB |
| | 4 | Kick Drum | 0.1778 | ~-15dB |
| | 5 | Lead Guitar | 0.1778 | ~-15dB |
| | 6 | Lead Vocals Double | 3.1623 | ~10dB |
| | 7 | Lead Vocals | 3.1623 | ~10dB |
| | 8 | Drums Overhead | 0.1778 | ~-15dB |

FIG 6

Figure - MUSHRA listening test results for PLS

MPG SAOC system overview 1010 1020 1030

| SAOC mode | Modified coefficients | Reference |
|---|---|---|
| "x-1-1" decoding mode | Mix matrix coefficients ($\mathbf{G}^{l,m}$) | 6.6.1.3 |
| "x-1-2" decoding mode | Mix matrix coefficients ($\mathbf{G}^{l,m}$) | 6.6.1.2 |
| "x-1-b" decoding mode | Mix matrix coefficients ($\mathbf{G}^{l,m}$) | 6.6.1.1 |
| "x-1-5" transcoding mode | Arbitrary downmix gain coefficients ($ADG^{l,m}$) | 6.5.2.4 |
| "x-2-1" decoding mode | Mix matrix coefficients ($\mathbf{G}^{l,m}$) | 6.6.1.6 |
| "x-2-2" decoding mode | Mix matrix coefficients ($\mathbf{G}^{l,m}$) | 6.6.1.5 |
| "x-2-b" decoding mode | Mix matrix coefficients ($\mathbf{G}^{l,m}$) | 6.6.1.4 |
| "x-2-5" transcoding mode | Prediction matrix coefficients ($\mathbf{C}_3$) | 6.5.3.3.1 |

FIG 10

APPARATUS, METHOD AND COMPUTER PROGRAM FOR PROVIDING ONE OR MORE ADJUSTED PARAMETERS FOR PROVISION OF AN UPMIX SIGNAL REPRESENTATION ON THE BASIS OF A DOWNMIX SIGNAL REPRESENTATION AND A PARAMETRIC SIDE INFORMATION ASSOCIATED WITH THE DOWNMIX SIGNAL REPRESENTATION, USING AN AVERAGE VALUE

CROSS-REFERENCE TO RELATED APPLICATIONS

This application is a continuation of copending International Application No. PCT/EP2010/065503, filed Oct. 15, 2010, which is incorporated herein by reference in its entirety, and additionally claims priority from U.S. applications Nos. U.S. 61/252,298, filed Oct. 16, 2009, U.S. 61/369,256, filed Jul. 30, 2010 and EP 10171459.0, filed Jul. 30, 2010, all of which are incorporated herein by reference in their entirety.

An embodiment according to the invention is related to an apparatus for providing one or more adjusted parameters for a provision of an upmix signal representation on the basis of a downmix signal representation and a parametric side information associated with the downmix signal representation.

Another embodiment according to the invention is related to an apparatus for providing an upmix signal representation on the basis of the downmix signal representation and the parametric side information.

Another embodiment according to the invention is related to a method for providing one or more adjusted parameters for a provision of an upmix signal representation on the basis of a downmix signal representation and a parametric side information associated with the downmix signal representation.

Another embodiment according to the invention is related to a computer program for performing said method.

Some embodiments according to the invention are related to a parameter limiting scheme for distortion control in MPEG SAOC.

BACKGROUND OF THE INVENTION

In the art of audio processing, audio transmission and audio storage, there is an increasing desire to handle multi-channel contents in order to improve the hearing impression. Usage of multi-channel audio content brings along significant improvements for the user. For example, a 3-dimensional hearing impression can be obtained, which brings along an improved user satisfaction in entertainment applications. However, multi-channel audio contents are also useful in professional environments, for example in telephone conferencing applications, because the speaker intelligibility can be improved by using a multi-channel audio playback.

However, it is also desirable to have a good tradeoff between audio quality and bitrate requirements in order to avoid an excessive resource load caused by multi-channel applications.

Recently, parametric techniques for the bitrate-efficient transmission and/or storage of audio scenes containing multiple audio objects has been proposed, for example, Binaural Cue Coding (Type I) (see, for example, reference [1]), Joint Source Coding (see, for example, reference [2]), and MPEG Spatial Audio Object Coding (SAOC) (see, for example, references [3], [4], [5]).

In combination with user interactivity at the receiving side, such techniques may lead to a low audio quality of the output signals if extreme object rendering is performed (see, for example, reference [6]).

These techniques aim at perceptually reconstructing the desired output audio scene rather than by a waveform match.

FIG. 8 shows a system overview of such a system (here: MPEG SAOC). The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects which provide the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820*c* may be configured to use the user interaction information/user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 822 to the upmix channel signals $\hat{y}_1$ to $\hat{y}_M$.

However, it should be noted that in many embodiments, the object separation, which is indicated by the object separator 820*a* in FIG. 8, and the mixing, which is indicated by the mixer 820*c* in FIG. 8, are performed in one single step. For this purpose, overall parameters may be computed which describe a direct mapping of the one or more downmix signals 812 onto the upmix channel signals $\hat{y}_1$ to $\hat{y}_M$. These parameters may be computed on the basis of the side information and the user interaction information/user control information 820.

Taking reference now to FIGS. 9*a*, 9*b* and 9*c*, different apparatus for obtaining an upmix signal representation on the basis of a downmix signal representation and object-related side information will be described. It should be noted that the object-related side information is an example of a side information associated with the downmix signal. FIG. 9*a* shows a block schematic diagram of an MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 926 receives the reconstructed object signals 924 associated with a plurality of N objects and provides, on the basis thereof and on the rendering information, one or more upmix channel signals 928. In the SAOC decoder 920, the extraction of the object signals 924 is performed separately from the mixing/rendering which allows for a separation of the object decoding functionality from the mixing/rendering functionality but brings along a relatively high computational complexity.

Taking reference now to FIG. 9*b*, another MPEG SAOC system 930 will be briefly discussed, which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent both on the object-related side information and the rendering information. The joint upmix process depends also on the downmix information, which is considered to be part of the object-related side information.

To summarize the above, the provision of the upmix channel signals 928, 958 can be performed in a one step process or a two step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information (for example, in the form of an MPEG Surround bitstream) on the basis of a received data. Accordingly, the side information transcoder 982 is configured to transform an object-related (parametric) side information, which is received from the object encoder, into a channel-related (parametric) side information, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, an SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, the general processing is carried out in a frequency selective way and can be described as follows within each frequency band:

- N input audio object signals $x_1$ to $x_N$ are downmixed as part of the SAOC encoder processing. For a mono downmix, the downmix coefficients are denoted by $d_1$ to $d_N$. In addition, the SAOC encoder 810 extracts side information 814 describing the characteristics of the input audio objects. For MPEG SAOC, the relations of the object powers with respect to each other are the most basic form of such a side information.
- Downmix signal (or signals) 812 and side information 814 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.
- On the receiving end, the SAOC decoder 820 conceptually tries to restore the original object signal ("object separation") using the transmitted side information 814 (and, naturally, the one or more downmix signals 812). These approximated object signals (also designated as reconstructed object signals 820*b*) are then mixed into a target scene represented by M audio output channels (which may, for example, be represented by the upmix channel signals $\hat{y}_1$ to $\hat{y}_M$) using a rendering matrix. For a mono output, the rendering matrix coefficients are given by $r_1$ to $r_N$.

Effectively, the separation of the object signals is rarely executed (or even never executed), since both the separation step (indicated by the object separator 820*a*) and the mixing step (indicated by the mixer 820*c*) are combined into a single transcoding step, which often results in an enormous reduction in computational complexity.

It has been found that such a scheme is tremendously efficient, both in terms of transmission bitrate (it is only a need to transmit a few downmix channels plus some side information instead of N discrete object audio signals or a discrete system) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface.

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg).

However, it has been found that the decoder-sided choice of parameters for the provision of the upmix signal representation (e.g. the upmix channel signals $\hat{y}_1$ to $\hat{y}_M$) brings along audible degradations in some cases.

SUMMARY

According to an embodiment, an apparatus for providing one or more adjusted parameters for a provision of an upmix signal representation on the basis of a downmix signal representation and a parametric side information associated with the downmix signal representation may have a parameter adjuster configured to receive one or more parameters and to provide, on the basis thereof, one or more adjusted parameters, wherein the parameter adjuster is configured to provide the one or more adjusted parameters in dependence on an average value of a plurality of parameter values, such that a distortion of the upmix signal representation caused by the use of non-optimal parameters for the provision of the upmix signal representation is reduced at least for one or more parameters deviating from optimal parameters by more than a predetermined deviation.

According to another embodiment, an apparatus for providing an upmix signal representation on the basis of a downmix signal representation and a parametric side information may have an apparatus for providing one or more adjusted parameters on the basis of one or more received parameters, for a provision of an upmix signal representation on the basis of a downmix signal representation and a parametric side information associated with the downmix signal representation, the apparatus having a parameter adjuster configured to receive one or more parameters and to provide, on the basis thereof, one or more adjusted parameters, wherein the parameter adjuster is configured to provide the one or more adjusted parameters in dependence on an average value of a plurality of parameter values, such that a distortion of the upmix signal representation caused by the use of non-optimal parameters for the provision of the upmix signal representation is reduced at least for one or more parameters deviating from optimal parameters by more than a predetermined deviation; a signal processor configured to acquire the upmix signal representation on the basis of the downmix signal representation and the parametric side information, wherein the apparatus for providing one or more adjusted parameters is configured to adjust one or more processing parameters of the signal processor.

According to another embodiment, a method for providing one or more adjusted parameters for the provision of an upmix signal representation on the basis of a downmix signal representation and a parametric side information associated with the downmix signal representation may have the steps of receiving one or more parameters; and providing, on the basis thereof, one or more adjusted parameters, wherein the one or more adjusted parameters are provided in dependence on an average value of a plurality of parameter values, such that a distortion of the upmix signal representation caused by the use of non-optimal parameters is reduced at least for one or more parameters deviating from optimal parameters by more than a predetermined deviation.

According to another embodiment, a computer program for may perform the above mentioned method, when the computer program runs on a computer.

This problem is solved by an apparatus for providing one or more adapted parameters for a provision of an upmix signal representation on the basis of a downmix signal representation and a parametric side information associated with the downmix signal representation. The apparatus comprises a parameter adjuster configured to receive one or more parameters (which may be input parameters in some embodiments) and to provide, on the basis thereof, one or more adjusted parameters. The parameter adjuster is configured to provide the one or more adjusted parameters in dependence on an average value of a plurality of parameter values (which may be input parameter values in some embodiments), such that the distortion of the upmix signal representation caused by the use of non-optimal parameters is reduced at least for parameters (or input parameters) deviating from optimal parameters by more than a predetermined deviation.

This embodiment according to the invention is based on the idea that an average value of a plurality of input parameter values constitutes a meaningful quantity which allows for an adjustment of parameters, which are used for a provision of an upmix signal representation on the basis of a downmix signal representation and a parametric side information associated with the downmix signal representation, because distortions are often caused by excessive deviations from such an average value. The usage of an average value allows for an adjustment of one or more parameters, to avoid such excessive deviations from the average value (also sometimes designated as a mean value), consequently bringing along the possibility to avoid an excessively degraded audio quality.

The above-discussed embodiment provides a concept for safeguarding the subjective sound quality of the rendered SAOC scene for which all processing may be carried out entirely within an SAOC decoder/transcoder, because the SAOC decoder/transcoder comprises the full information needed for the adjustment of the parameters. Also, the above-described embodiment does not involve the explicit calculation of sophisticated measures of perceived audio quality of the rendered scene, because it has been found that a limitation of a deviation between a parameter value and an average value typically results in a good hearing impression while large deviations between a parameter value and an average value typically result in audible distortions. Thus, the above-discussed embodiment provides for a particularly efficient mechanism, namely the use of the average value, for appropriately adjusting the parameters which are considered for the provision of the upmix signal representation.

In an embodiment, the parameter adjuster of the apparatus is configured to provide the one or more adjusted parameters in dependence on an average value which is a weighted average of a plurality of parameter values. Using a weighted average provides a high degree of freedom, because t is possible to allocate different weights to different of the parameter values. However, allocating identical weights to the parameter values is also possible.

In an embodiment, the parameter adjuster of the apparatus is configured to provide the one or more adjusted parameters such that the one or more adjusted parameters deviate from the average value less than corresponding received parameters. By bringing the adjusted parameters close to the average value, or by even setting the adjusted parameters to be equal to the average value, a significant reduction of distortions can be achieved.

In an embodiment, the apparatus is configured to receive one or more rendering coefficients (also designated as rendering parameters) describing contributions of audio objects to one or more channels of the upmix signal representation. In this case, the apparatus is advantageously configured to provide one or more adjusted rendering coefficients as the adjusted parameters. It has been found that adjusting rendering parameters in dependence on an average value of a plurality of rendering parameters, which serve as input parameter values, brings along the possibility to obtain well-suited adjusted rendering parameters, which avoid excessive audible distortions.

In an embodiment, the parameter adjuster is configured to receive, as the input parameters, a plurality of rendering coefficients. In this case, the parameter adjuster is configured to compute an average over rendering coefficients associated with a plurality of audio objects. Also, the parameter adjuster is configured to provide the adjusted rendering coefficients such that a deviation of an adjusted rendering coefficient from the average over rendering coefficients associated with a plurality of audio objects is restricted. This embodiment according to the invention is based on the finding that a distortion of the upmix signal representation caused by the use of non-optimal rendering parameters is typically reduced, at least for rendering parameters deviating from optimal rendering parameters by more than a predetermined deviation, if a deviation of an adjusted rendering coefficient from the average over rendering coefficients associated with a plurality of audio objects is restricted. Thus, a simple mechanism, namely the adjustment of the rendering coefficients such that the deviation of the adjusted rendering coefficients from the average over rendering coefficients associated with a plurality of audio objects is restricted, allows to avoid excessive audible distortions.

In an embodiment, the parameter adjuster is configured to leave a rendering coefficient, which is within a tolerance interval determined in dependence on the average over the rendering coefficients, unchanged, and to selectively set a rendering coefficient, which is larger than an upper boundary value of the tolerance interval to a value which is smaller than or equal to the upper boundary value, and to selectively set a rendering coefficient, which is smaller than a lower boundary value of the tolerance interval to a value which is larger than or equal to the lower boundary value. Accordingly, a very simple mechanism is established for adjusting the rendering coefficients, wherein this simple mechanism still allows to obtain adjusted rendering coefficients, which avoid an excessive distortion of the upmix signal representation which would be caused by the use of non-optimal rendering parameters that are strongly different from the average value.

In an embodiment, the parameter adjuster is configured to iteratively select a respective one of the rendering coefficients, which comprises a maximum deviation from the average over the rendering coefficients in the respective iteration, and to bring the selected one of the rendering coefficients closer to the average over the rendering coefficients. Accordingly, the rendering parameters which are outside of a tolerance interval determined in dependence on the average over the rendering coefficients are iteratively brought into the tolerance interval. Thus, the rendering parameters are adjusted in dependence on the average value such that a distortion of the upmix signal representation caused by the use of non-optimal rendering parameters is typically reduced (at least for input rendering parameters deviating from optimal rendering parameters by more than a predetermined deviation).

In an embodiment, the parameter adjuster is configured to repeat the iterative selection of a respective one of the rendering coefficients and the iterative modification of a selected one of the rendering coefficients until all rendering parameters are adjusted to be within applicable tolerance intervals. Accordingly, it is ensured that audible distortions in the upmix signal representation are kept sufficiently small.

In an embodiment, the apparatus is configured to receive one or more transcoding coefficients describing a mapping of one or more channels of the downmix signal representation onto one or more channels of the upmix signal representation. In this case, the apparatus is configured to provide one or more adjusted transcoding coefficients as the adjusted parameters. This embodiment according to the invention is based on the finding that transcoding parameters are also well-suited for an adjustment in dependence on an average value, because large deviations of the transcoding coefficients from the average value typically cause audible distortions. Accordingly, it is possible to reduce distortions of the upmix signal representation caused by the use of non-optimal transcoding parameters (at least for input transcoding parameters deviating from optimal transcoding parameters by more than a predetermined deviation) by an adjustment or a limitation of the transcoding parameters in dependence on the average value.

In an embodiment, the parameter adjuster is configured to receive, as the input parameters, a temporal sequence of transcoding coefficients (also designated as transcoding parameters). In this case, the parameter adjuster is configured to compute a temporal mean (also designated as a temporal average) in dependence on a plurality of transcoding coefficients. Also, the parameter adjuster is configured to provide the adjusted transcoding coefficients such that a deviation of the adjusted transcoding coefficients from the temporal mean is restricted. Again, a simple mechanism for avoiding excessive audible distortions of an upmix signal representation caused by the use of non-optimal transcoding coefficients is created.

In an embodiment, the parameter adjuster is configured to leave a transcoding coefficient, which is within a tolerance interval determined in dependence on the temporal mean (which constitutes the average value) unchanged. Also, the parameter adjuster is configured to selectively set a transcoding coefficient, which is larger than an upper boundary value of the tolerance interval, to a value which is smaller than or equal to the upper boundary value of the tolerance interval, and to selectively set a transcoding coefficient, which is smaller than a lower boundary value of the tolerance interval, to a value which is larger than or equal to the lower boundary value. Accordingly, the transcoding coefficients can be brought into a well-defined tolerance interval, which allows to reduce distortions of an upmix signal representation caused by the use of non-optimal transcoding coefficients at least for transcoding coefficients deviating from optimal transcoding coefficients by more than a predetermined deviation. The tolerance interval is chosen in an adaptive manner, as the temporal mean is used. This concept is based on the finding that strong temporal changes of the transcoding coefficients typically bring along audible distortions and should therefore be limited to some degree.

In an embodiment, the parameter adjuster is configured to calculate the temporal mean using a recursive low pass filtering of the sequence of transcoding coefficients. This concept has shown to bring along a very well-defined temporal mean, which takes into account a long-term evolution of the transcoding coefficients. Also, it has been found that such a recursive low pass filtering of the sequence of transcoding coefficients can be effected with little computational effort and memory effort, which helps to reduce the memory requirements. In particular, it is possible to obtain a meaningful temporal mean without storing the transcoding coefficient history for an extended period of time.

In an embodiment, the parameter adjuster is configured to provide a given one of the one or more adjusted parameters such that the given one of the adjusted parameters is within a tolerance interval, boundaries of which are defined in dependence on the average value of the plurality of input parameter values and one or more tolerance parameters, and such that a deviation between an input parameter and a corresponding adjusted parameter is minimized or kept within a predetermined maximal allowable range. It has been found that adjusted parameters bringing along a good hearing impression can be obtained by restricting the adjusted parameters to a tolerance interval while also considering the objective to avoid excessively large differences between an input parameter and a corresponding adjusted parameter. Accordingly, a distortion of the upmix signal representation caused by the use of non-optimal parameters can be reduced without unnecessarily compromising desired auditory settings defined by the input parameters.

In an embodiment, the parameter adjuster is configured to selectively set an input parameter, which is found to be outside of the tolerance interval, boundaries of which tolerance interval are defined in dependence on the average value of the plurality of input parameter values, to an upper boundary value or a lower boundary value of the tolerance interval, in order to obtain an adjusted version of the input parameter.

In another embodiment, the parameter adjuster is configured to iteratively select a respective one of the input parameters, which comprises a maximum deviation from the average value in a respective iteration, and to bring the selected one of the input parameters closer to the average value, in order to iteratively bring input parameters, which are outside of a tolerance interval (boundaries of which are defined in dependence on the average value) into the tolerance interval.

In an embodiment, the parameter adjuster is configured to choose a step size used to bring the selected one of the input parameters closer to the average value to be a predetermined fraction of a difference between the selected one of the input parameters and the average value.

Another embodiment according to the invention creates an apparatus for providing an upmix signal representation on the basis of a downmix signal representation and a parametric side information. Said apparatus comprises an apparatus for providing one or more adjusted parameters on the basis of one or more input parameters, as discussed before. The apparatus for providing an upmix signal representation also comprises a signal processor configured to obtain the upmix signal representation on the basis of the downmix signal representation and a parametric side information. The apparatus for providing one or more adjusted parameters is configured to provide adjusted versions of one or more processing parameters of the signal processor, for example, of rendering parameters input to the signal processor or of transcoding parameters computed in the signal processor and applied by the signal processor to obtain the upmix signal representation.

This embodiment is based on the finding that there is a large number of parameters, which are applied by the signal processor and either input into the signal processor or even calculated in the signal processor, and which can benefit from the above-discussed parameter adjustment on the basis of the average value. It has been found that the signal processor typically provides a good quality upmix signal representation, with small distortions, if a set of parameters (for example, a set of rendering coefficients associated with different audio objects, or a set of transcoding parameter values associated with different instances in time) is well-balanced, such that the individual values of such a set of values do not comprise excessively large deviations from an average value. Thus, by applying the apparatus for providing one or more adjusted parameters in combination with an apparatus for providing an upmix signal representation, the benefits of the inventive concept can be realized.

In an embodiment, the signal processor is configured to provide the upmix signal representation in dependence on adjusted rendering coefficients describing contributions of audio objects to one or more channels of the upmix signal representation. The apparatus for providing one or more adjusted parameters is configured to receive a plurality of user-specified rendering parameters as input parameters and to provide, on the basis thereof, one or more adjusted rendering parameters for use by the signal processor (advantageously to the signal processor). It has been found that well-balanced rendering parameters, which can be obtained using the apparatus for providing one or more adjusted parameters, typically result in a good hearing impression.

In another embodiment, the apparatus for providing the one or more adjusted parameters is configured to receive one or more mix matrix elements of a mix matrix as the one or more input parameters, and to provide, on the basis thereof, one or more adjusted mix matrix elements of the mix matrix for use by the signal processor. In this case, the signal processor is configured to provide the upmix signal representation in dependence on the adjusted mix matrix elements of the mix matrix, wherein the mix matrix describes a mapping of one or more audio channel signals of the downmix signal representation (represented, for example, in the form of a time domain representation or in the form of a time-frequency-domain representation) onto one or more audio channel signals of the upmix signal representation. It has been found that the mix matrix elements should also be well-adapted to the average value, for example, in that temporal changes of the mix matrix elements are limited.

In another embodiment according to the invention, the audio processor is configured to obtain an MPEG surround arbitrary-downmix-gain value. In this case, the apparatus for providing one or more adjusted parameters is configured to receive a plurality of arbitrary-downmix-gain values as input parameters, and to provide a plurality of adjusted arbitrary-downmix-gain values. It has been found that an application of the apparatus for providing adjusted parameters to arbitrary-downmix-gain values also results in a good hearing impression and allows to limit audible distortions.

Further embodiments according to the invention create a method and a computer program for providing one or more adjusted parameters. Said embodiments are based on the same findings as the above-discussed apparatus and can be extended by any of the features and functionalities discussed herein with respect to the inventive apparatus.

BRIEF DESCRIPTION OF THE DRAWINGS

FIG. 5*a* shows a table representing listening test conditions;

FIG. 5*b* shows a table representing audio items of listening test;

FIG. 6 shows a table representing tested extreme rendering conditions;

FIG. 10 shows a table describing which transcoding coefficients can be modified by the proposed parameter limiting scheme.

DETAILED DESCRIPTION OF THE INVENTION

1. Apparatus for Providing One or More Adjusted Parameters, According to FIG. 1

Figure 1:
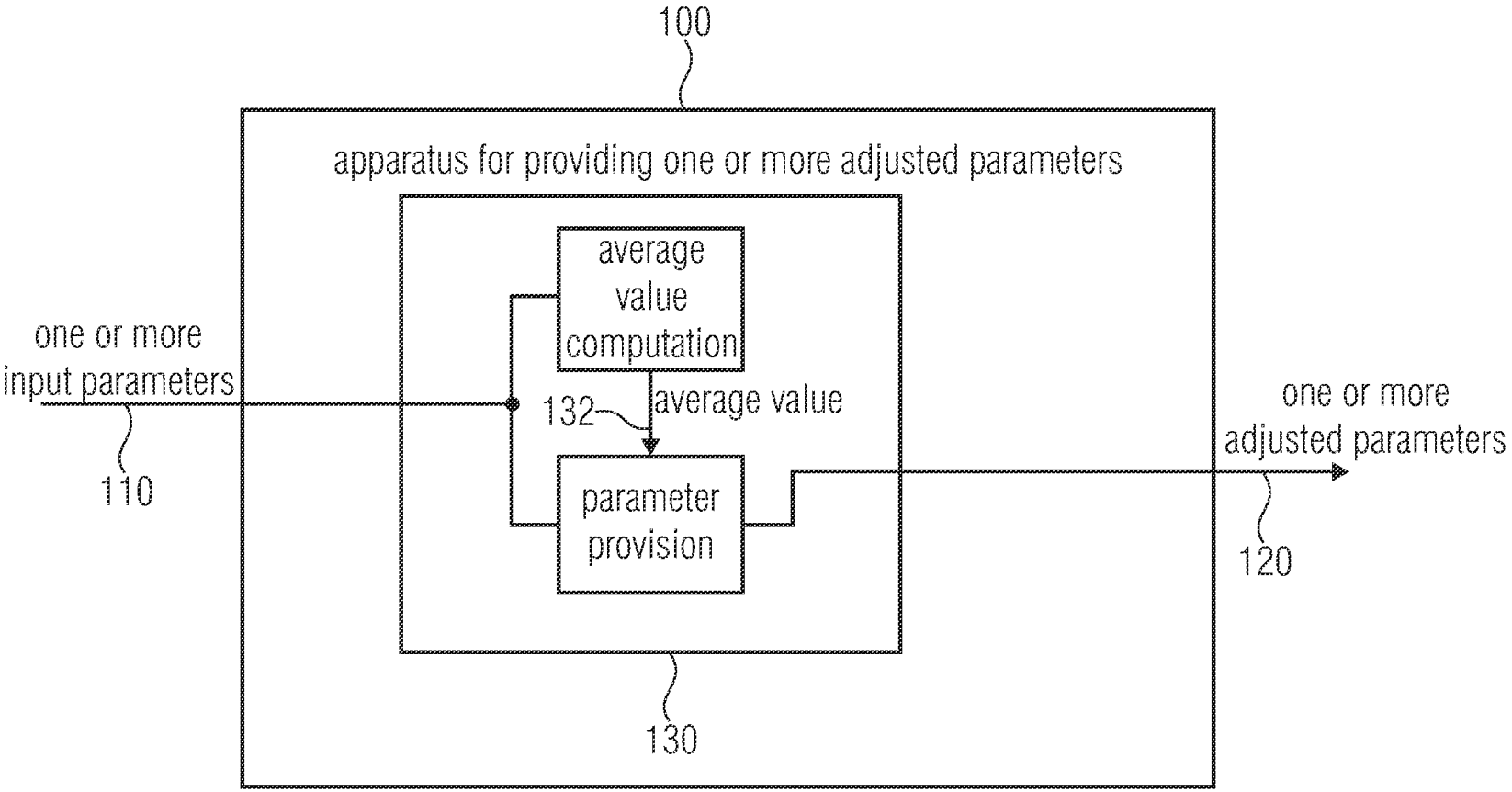
FIG. 1 shows a block schematic diagram of an apparatus for providing one or more adjusted parameters, according to an embodiment of the invention.

In the following, an apparatus for providing one or more adjusted parameters for a provision of an upmix signal representation on the basis of a downmix signal representation and a parametric side information associated with the downmix signal representation will be described. FIG. 1 shows a block schematic diagram of such an apparatus 100.

The apparatus 100 is configured to receive one or more input parameters 110 and to provide, on the basis thereof, one or more adjusted parameters 120. The apparatus 100 comprises a parameter adjuster 130 which is configured to receive the one or more input parameters 110 and to provide, on the basis thereof, the one or more adjusted parameters 120. The parameter adjuster 130 is configured to provide the one or more adjusted parameters 120 in dependence on an average value 132 of a plurality of input parameter values, such that a distortion of an upmix signal representation caused by the use of non-optimal parameters (for example, the one or more input parameters 110) is reduced at least for input parameters (for example, input parameters 110) deviating from optimal parameters by more than a predetermined deviation. For example, the parameter adjuster 130 may have the effect that the one or more adjusted parameters 120 are "closer" (in the sense of causing smaller distortions) to optimal parameters (which would result in a distortion-free upmix signal representation) than the one or more input parameters 110.

For this purpose, the parameter adjuster 130 implements an average value computation, to obtain the average value 132 (for example, as a temporal average or an inter-object average) of a set of related input parameters 110 (for example, input parameters associated with a common time interval, or input parameters of the same parameter type associated with different time instances). Regarding the operation of the apparatus 100, it should be noted that the provision of the one or more adjusted parameters 120 on the basis of the one or more input parameters 110 is made in dependence on the average value 132, because it has been found that the average value 132 is a meaningful quantity for adjusting the parameters. In particular, it has been found that moderate parameters (with respect to the average value) typically bring along moderate distortions.

Further details will be described subsequently.

2. Apparatus for Providing an Upmix Signal Representation, According to FIG. 2

Figure 2:
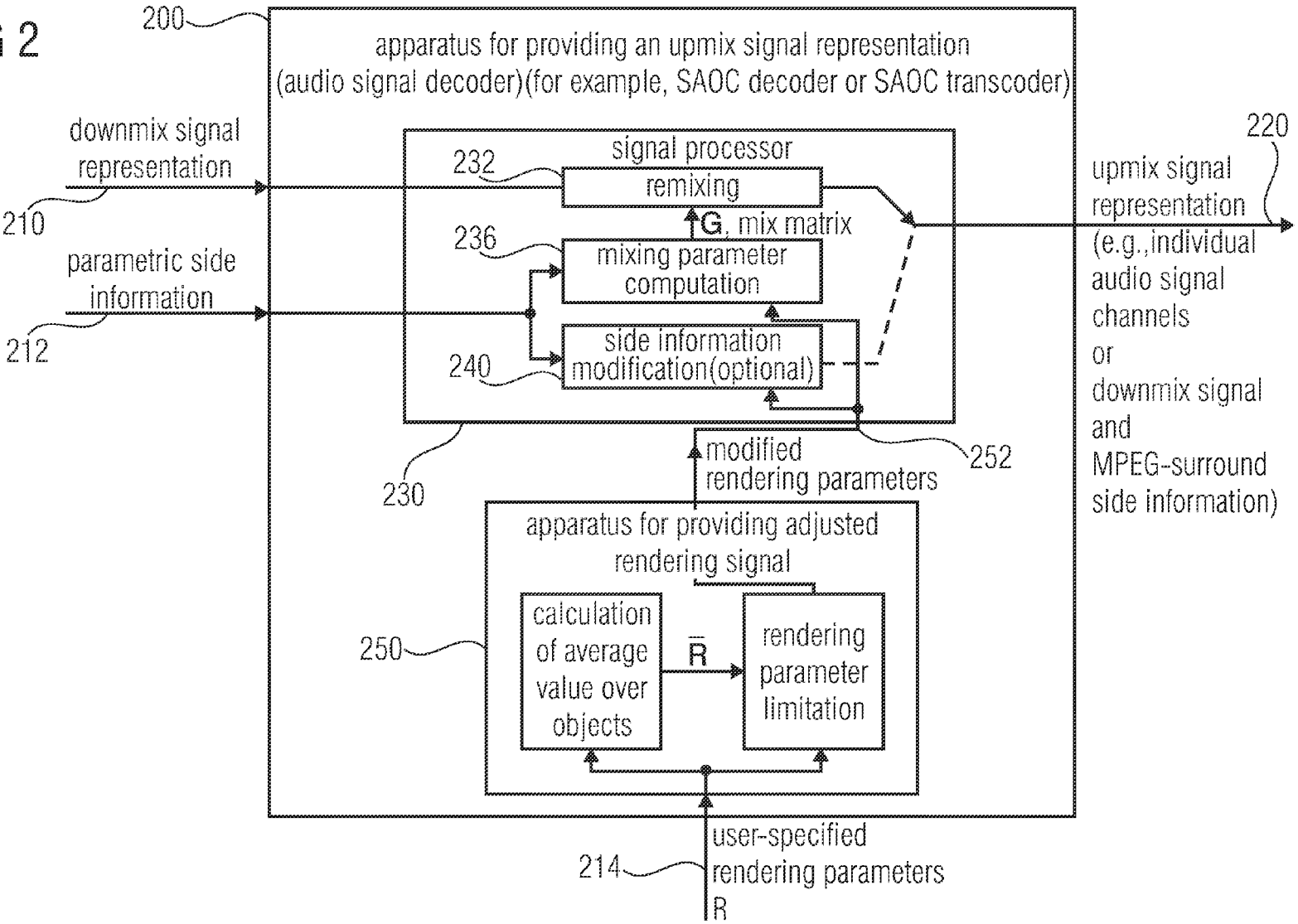
FIG. 2 shows a block schematic diagram of an apparatus for providing an upmix signal representation, according to an embodiment of the invention.

In the following, an apparatus for providing an upmix signal representation according to FIG. 2 will be described. FIG. 2 shows a block schematic diagram of such an apparatus 200, which can be considered as an audio signal decoder. For example, the apparatus 200 may comprise the functionality of an SAOC decoder or an SAOC transcoder.

The apparatus 200 is configured to receive a downmix signal representation 210 and a parametric side information 212. Also, the apparatus 200 is configured to receive user-specified rendering parameters 214. The apparatus is configured to provide an upmix signal representation 220.

The downmix signal representation 210 may, for example, be a representation of a one-channel audio signal or of a two-channel audio signal. The downmix signal representation 210 may, for example, be a time domain representation or an encoded representation. In some embodiments, the downmix signal representation 210 may be a time-frequency-domain representation, in which the one or more channels of the downmix signal representation 210 are represented by subsequent sets of spectral values.

The upmix signal representation 220 may, for example, be a representation of individual audio channels, for example, in the form of a time domain representation or a time-frequency-domain representation. Alternatively, the upmix signal representation 220 may be an encoded representation, comprising both a downmix signal representation and a channel-related side information, for example, an MPEG Surround side information.

The user-specified rendering parameters 214 may be provided in the form of rendering matrix entries describing desired contributions of a plurality of audio objects to the one or more channels of the upmix signal representation 220. Alternatively, the user-specified rendering parameters 214 may be provided in any other appropriate form, for example, specifying a desired rendering position and rendering volume of the audio objects.

The apparatus 200 comprises a signal processor 230, which is configured to provide the upmix signal representation 220 on the basis of the downmix signal representation 210 and the parametric side information 212. The signal processor 230 comprises a remixing functionality 232 in order to provide the upmix signal representation 220 on the basis of the downmix signal representation 210. For example, the remixing functionality 232 may be configured to linearly combine a plurality of channels of the downmix signal representation 212 in order to obtain the one or more channels of the upmix signal representation 220. In this remixing, contributions of the channels of the downmix signal representation 210 to the channels of the upmix signal representation 220 may be determined by mix matrix elements of a mix matrix G, wherein a first dimension (for example, a number of rows) of the mix matrix G may be determined by the number of channels of the upmix signal representation 220, and wherein a second dimension (for example, a number of columns) of the mix matrix G may be determined by a number of channels of the downmix signal representation 210.

For example, the remixing process 232 may be used to provide one or more vectors comprising spectral values associated with one or more channels of the upmix signal representation 220 by multiplying one or more vectors comprising spectral values of one or more channels of the downmix signal representation 210 with the mix matrix G.

The signal processor 230 may also comprise a mixing parameter computation 236 which provides the mix matrix G (or equivalently, the elements thereof). The mix matrix elements are determined in dependence on the parametric side information 212 and modified rendering parameters 252 by the mixing parameter computation 236. The mix matrix elements of the mix matrix G are, for example, provided such that the one or more channels of the upmix signal representation 220 describe audio objects, which are represented by the one or more channels of the downmix signal representation 210, in accordance with the modified rendering parameters 252. For this purpose, the parametric side information 212 is evaluated by the mixing parameter computation 236, wherein the parametric side information 212 comprises, for example, an object-level difference information OLD, an inter-object-correlation information IOC, a downmix gain information DMG and (optionally) a downmix-channel-level-difference information DCLD. The object-level difference information may describe, for example, in a frequency-band-wise manner, level differences between a plurality of audio objects. Similarly, the inter-object-correlation information may describe, for example, in a frequency-band-wise manner, correlations between a plurality of audio objects. The downmix-gain information and the (optional) downmix-channel-level-difference information may describe the downmix, which is performed to combine audio object signals from a plurality of audio objects into the one or more channels of the downmix signal representation, wherein there are typically more audio objects than channels of the downmix signal representation 210.

Accordingly, the mixing parameter computation 236 may evaluate how the mix matrix elements should be chosen in order to obtain an upmix signal representation 220 comprising expected statistic properties on the basis of the parametric side information 212 and the modified rendering parameters 252.

The signal processor 230 may optionally comprise a side information modification or side information transformation 240, which is configured to receive the parametric side information 212 and to provide a modified side information (for example, an MPEG Surround side information), such that the modified side information and the associated remixed downmix signal representation provided by the remixing process 232 describe a desired audio scene.

To summarize, the signal processor 230 may, for example, fulfill the functionality of the SAOC decoder 820, wherein the downmix signal representation 210 takes the role of the one or more downmix signals 812, wherein the parametric side information 212 takes the role of the side information 814, and wherein the upmix signal representation 220 is equivalent to the output channel signals $\hat{y}_1$ to $\hat{y}_M$.

Alternatively, the signal processor 230 may comprise the functionality of the separate decoder and mixer 920, wherein the downmix signal representation 210 may take the role of the one or more downmix signals, wherein the parametric side information 212 may take the role of the object meta data, and wherein the upmix signal representation 220 may take the role of the one or more output channel signals 928.

Alternatively, the signal processor 230 may comprise the functionality of the integrated decoder and mixer 950, wherein the downmix signal representation 210 may take the role of the one or more downmix signals, wherein the parametric side information 212 may take the role of the object meta data, and wherein the upmix signal representation 220 may take the role of the one or more output channel signals 958.

Alternatively, the signal processor 230 may comprise the functionality of the SAOC-to-MPEG surround transcoder 980, wherein the downmix signal representation 210 may take the role of the one or more downmix signals, wherein the parametric side information 212 may take the role of the object meta data, and wherein the upmix signal representation may be equivalent to the one or more downmix signals 988 when taken in combination with the MPEG surround bitstream 984.

In any case, the modified rendering parameters 252 may take the role of the user interaction/control information 822 or of the rendering information.

The apparatus 200 also comprises an apparatus 250 for providing adjusted rendering parameters. The apparatus 250 for providing the adjusted rendering parameters receives the user-specified rendering parameters 214 and provides, on the basis thereof, the modified rendering parameters 252. The apparatus 250 is typically configured to calculate an average value over a plurality of user-specified rendering parameters associated with different audio objects, to obtain an average value. Also, the apparatus 250 is configured to perform a rendering parameter limitation in dependence on the average value, to obtain the modified rendering parameters 252 by limiting the user-specified rendering parameters 214. A tolerance interval, to which the modified rendering parameters 252 are limited, is typically determined in dependence on the average value, such that strong deviations of the modified rendering parameters 252 from the average value are avoided, even if one or more of the user-specified rendering parameters 214 comprises such a strong deviation from the average value. In this manner, excessive distortions within the upmix signal representation 220 are typically avoided, because the modified rendering parameters 252, which comprise limited inter-object deviation, will result in an upmix signal representation with low-distortions, while a large difference between rendering parameters associated with different audio objects would typically result in audible artifacts.

It should be noted here that the apparatus 250 for providing adjusted rendering coefficients may comprise the same overall functionality as apparatus 100 for providing one or more adjusted parameters, wherein the user-specified rendering parameters 214 may take the role of one or more input parameters 110, and wherein the adjusted rendering parameters 252 may take the role of the one or more adjusted parameters 120.

Details regarding the provision of the modified rendering parameters 252 will be discussed below, taking reference to FIG. 4.

3. Apparatus for Providing an Upmix Signal Representation, According to FIG. 3

Figure 3:
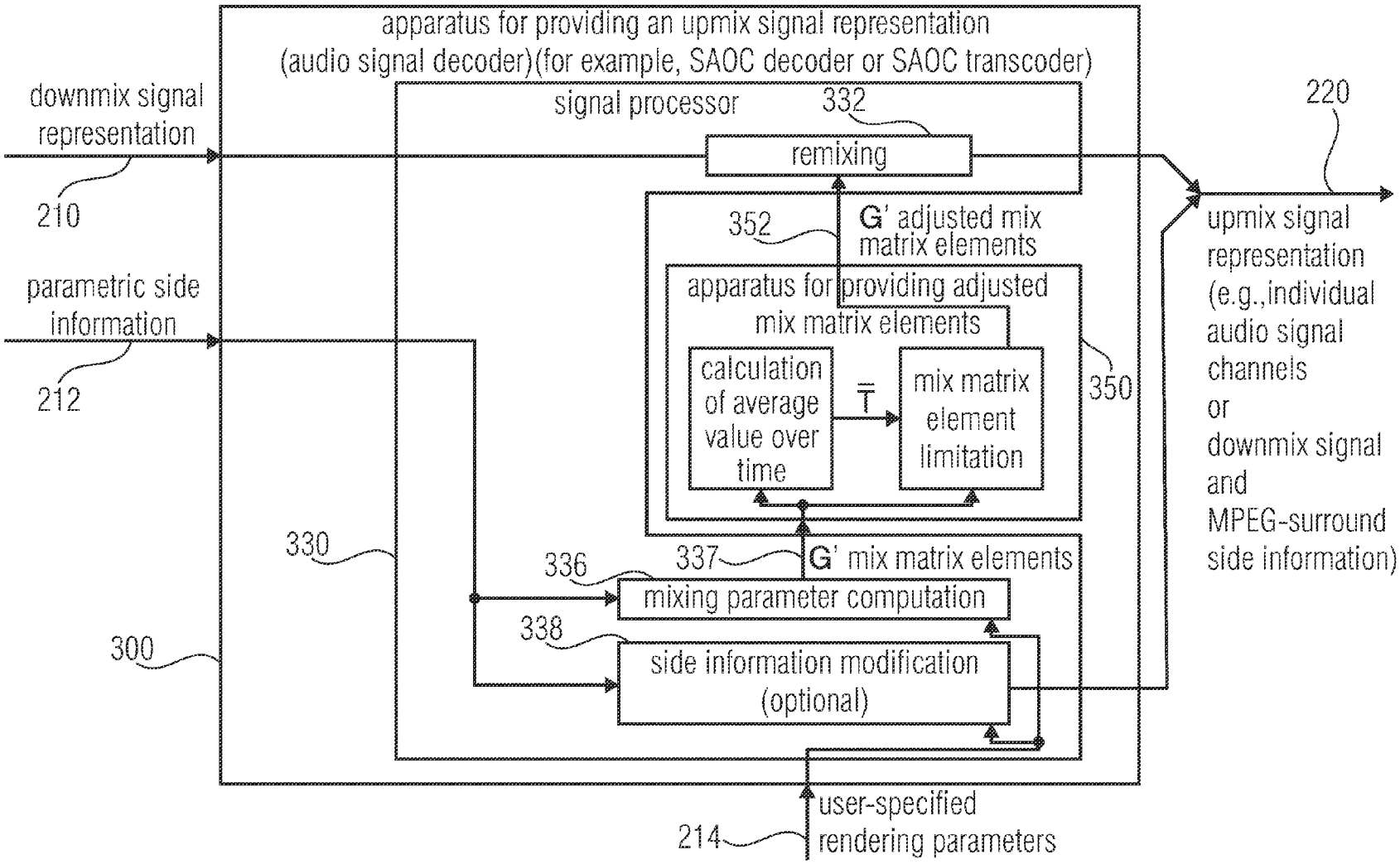
FIG. 3 shows a block schematic diagram of an apparatus for providing an upmix signal representation, according to another embodiment of the invention.

In the following, an apparatus for providing an upmix signal representation according to another embodiment of the invention will be described taking reference to FIG. 3, which shows a block schematic diagram of such an apparatus 300.

The apparatus 300 typically receives the same type of input signals and provides the same type of output signals as the apparatus 200, such that identical reference numerals are used herein to describe identical or equivalent signals. To summarize, the apparatus 300 receives a downmix signal representation 210, parametric side information 212 and user-specified rendering parameters 214, and the apparatus 300 provides, on the basis thereof, an upmix signal representation 220.

The apparatus 300 comprises a signal processor 330, which may be substantially equivalent in the functionality to the signal processor 230. The signal processor 330 comprises a remixing functionality 332, which is identical to the remixing functionality 232 of the signal processor 230 in that it provides remixed audio channel signals on the basis of the downmix signal representation. However, the remixing 332 uses an adjusted mix matrix, rather than a mix matrix obtained directly from a mixing parameter computation.

The signal processor 330 also comprises a mixing parameter computation 336, which may be identical in function to the mixing parameter computation 236 of the signal processor 230. Accordingly, the mixing parameter computation 336 receives the parametric side information 212 and the user-specified rendering parameters 214, and provides, on the basis thereof, a mix matrix G (or equivalently, mix matrix elements of the mix matrix G, which are also designated with 337).

The signal processor 330 optionally also comprises a side information modification 338, the functionality of which is identical to the side information modification 240.

In addition, the apparatus 300 comprises an apparatus 350 for providing adjusted mix matrix elements. The apparatus 350 may or may not be part of the signal processor 330. The apparatus 350 is configured to receive the mix matrix 337, G (or, equivalently, the mix matrix elements thereof), which are provided by the mixing parameter computation 336, and to provide, on the basis thereof, an adjusted mix matrix 352 G' (or, equivalently, adjusted mix matrix elements thereof). For example, one set of mix matrix elements and one set of adjusted mix matrix elements may be provided per frequency band and per audio frame. In other words, the mix matrix G and the modified mix matrix G' may be updated once per audio frame of the downmix signal representation 210, if a frame-wise processing is chosen. However, the update interval may be different in some cases. Also, it is not necessary that there are multiple mix matrices and adjusted mix matrices G, G' for different frequency bands.

However, the apparatus 350 is configured to provide adjusted mix matrix elements of the adjusted mix matrix 352 on the basis of the mix matrix elements of the mix matrix 337 provided by the mixing parameter computation 336. For example, the processing may be performed individually per position of the mix matrix (or adjusted mix matrix), such that a sequence of adjusted mix matrix elements of a given mix matrix position may be dependent on a sequence of mix matrix elements of the mix matrix 337 at the same mix matrix position, but independent from mix matrix elements at different mix matrix positions.

The apparatus 350 for providing an adjusted mix matrix element is configured to provide the one or more adjusted mix matrix elements of the adjusted mix matrix 352 in dependence on one or more average values (for example, one or more matrix-position-individual average values) computed on the basis of the mix matrix 337. The apparatus 350 for providing the adjusted mix matrix elements of the adjusted mix matrix 352 is advantageously configured to calculate an average value of mix matrix elements at a given mix matrix position over time. Thus, for a given mix matrix position, an average value (advantageously, but not necessarily, a temporal average value, like, for example, a floating average or a quasi-infinite-impulse-response average value or an average value obtained by a recursive low pass filtering or similar mathematical operations well-known for time averaging) may be computed on the basis of a sequence of mix matrix elements of the given mix matrix position. For example, a sequence of mix matrix elements describing a contribution of a given channel of the downmix signal representation 210 onto a given channel of the upmix signal representation 220, which mix matrix elements are associated with a plurality of audio frames, may be used in order to obtain such an average value (also designates as mean value), which average value may be a finite-impulse-response average value or a (quasi) infinite-impulse-response average value (obtained, for example, using a recursive low pass filtering or similar mathematical operations well-known for time averaging). A current adjusted mix matrix element of the given mix matrix position (describing the contribution of the given channel of the downmix signal representation 210 onto the given channel of the upmix signal representation 220) may be limited by the apparatus 350 to a tolerance interval which is defined in dependence on the average value associated to the given mix matrix position.

Accordingly, excessive temporal fluctuations of mix matrix elements are avoided, because adjusted mix matrix elements are restricted to a tolerance interval which is determined, for example, by an average (finite-impulse-response average or infinite-impulse-response average) of previous mix matrix elements at the same mix matrix position. It has been found that such a restriction of the adjusted mix matrix elements of the adjusted mix matrix 352 typically brings along a limitation of the distortions of the upmix signal 220 caused by the use of non-optimal parameters (for example non-optimal user-specified rendering parameters) at least if the non-optimal user-specified rendering parameters deviate from optimal user-specified rendering parameters by more than a predetermined deviation.

It should be noted here that the apparatus 350 for providing adjusted mix matrix elements may comprise the same overall functionality as apparatus 100 for providing one or more adjusted parameters, wherein the mix matrix elements of the mix matrix 337 may take the role of one or more input parameters 110, and wherein the adjusted mix matrix elements of the adjusted mix matrix 352 may take the role of the one or more adjusted parameters 120.

4. Parameter Limiting Schemes According to FIG. 4

In the following, parameter limiting schemes according to the invention will be described taking reference to FIG. 4, which shows a schematic representation of such parameter limiting schemes.

Figure 4:
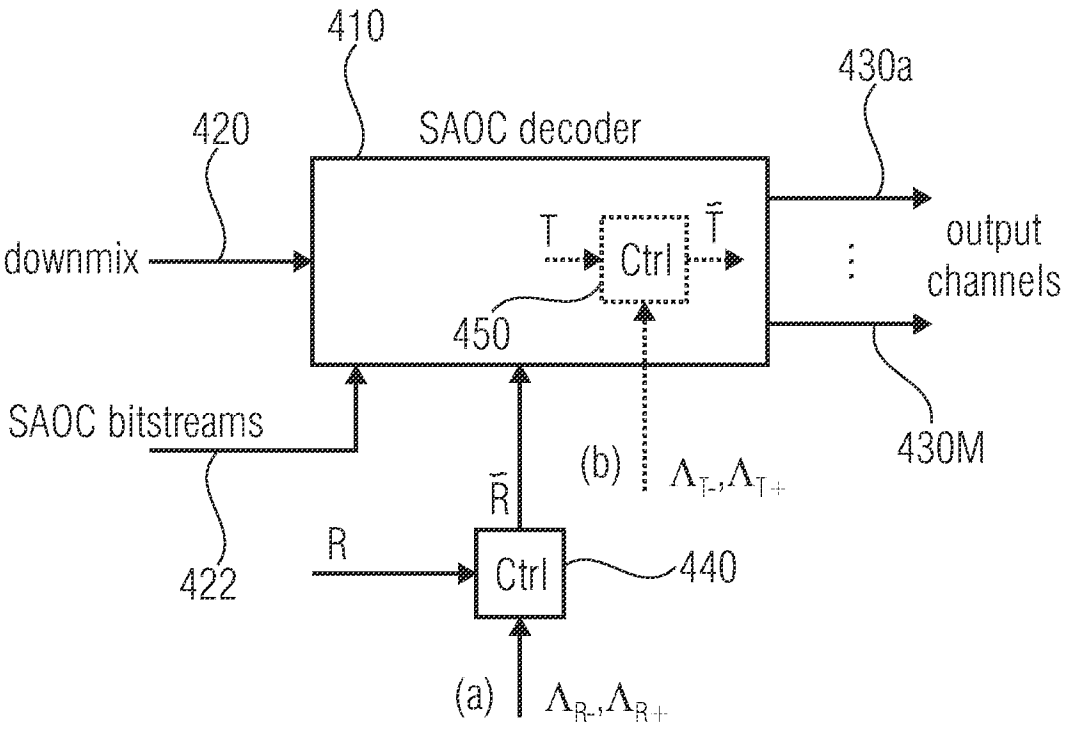
FIG. 4 shows a schematic representation of parameter limiting schemes using an indirect control and a direct control.

FIG. 4 shows the application of parameter limiting schemes in combination with an SAOC decoder 410. However, the parameter limiting schemes may be applied in combination with different types of audio decoders or audio transcoders, like, for example, an SAOC transcoder.

SAOC decoder 410 receives a downmix 420 and an SAOC bitstream 422. Also, the SAOC decoder provides one or more output channels 430*a* to 430M.

In a first implementation, designated with (a), the parameter limiting scheme 440 implements an indirect control. The parameter limiting scheme 440 receives an input rendering matrix R, for example, a user specified rendering matrix, and provides, on the basis thereof, an adjusted rendering matrix $\tilde{R}$ to the SAOC decoder. In this case, the SAOC decoder uses the adjusted rendering matrix $\tilde{R}$ for a derivation of the mix matrix G, as described above. The parameter limiting scheme 440 may also receive parameters $\Lambda_{R-}$, $\Lambda_{R+}$, which may determine boundaries of a tolerance interval.

Alternatively, or in addition, a second parameter limiting scheme 450 may be applied. The second parameter limiting scheme receives transcoding parameters T and provides, on the basis thereof, adjusted transcoding parameters $\tilde{T}$. The transcoding parameters T may be computed in the SAOC decoder 410, and the adjusted transcoding parameters $\tilde{T}$ may be applied by the SAOC decoder 410. For example, the transcoding parameters T may be equivalent to the mix matrix elements of the mix matrix G, as discussed before, and the adjusted transcoding parameters $\tilde{T}$ may be equivalent to the adjusted mix matrix elements of the adjusted mix matrix G'.

The parameter limiting scheme 450 may receive one or more parameters $\Lambda_{T-}$, $\Lambda_{T+}$, which parameters may determine boundaries of tolerance intervals.

4.1 Overview

In the following, an overview will be given over the parameter limiting scheme for distortion control.

The general SAOC processing is carried out in a time/frequency selective way and will be described in the following.

The SAOC encoder extracts the psychoacoustic characteristics (for example, object power relations and correlations) of several input audio object signals and then downmixes them into a combined mono or stereo channel (which may be designated, for example, as a downmix signal representation). This downmix signal and extracted side information are transmitted (or stored) in compressed format using the well-known perceptual audio coders. On the receiving end, the SAOC decoder conceptually tries to restore the original object signal (i.e., separate downmixed objects) using the transmitted side information (for example, object-level-difference information OLD, inter-object-correlation information IOC, downmix-gain information DMG and downmix-channel-level-difference information DCLD). These approximated object signals are then mixed into a target scene using a rendering matrix (wherein the rendering matrix typically describes contributions of different audio objects to different channels of the upmix signal representation). The rendering matrix is composed of the relative rendering coefficients RCs (or object gains) specified for each transmitted audio object and upmix setup loudspeaker. These object gains determine the spatial position of all separated/rendered objects. Effectively, the separation of the object signals is rarely executed (or even never executed) since the separation and the mixing is performed in a single combined processing step, which results in an enormous reduction of computational complexity. The single combined processing step may, for example, be performed using transcoding coefficients, which describe the combination of the object separation and mixing of the separated objects.

It has been found that this scheme is tremendously efficient, both in terms of transmission bitrate (it is only needed to transmit one or two downmix channels plus some side information instead of a number of individual object audio signals) and computational complexity (the processing complexity relates mainly to the number of output channels rather than the number of audio objects).

The SAOC decoder transforms (on a parametric level) the object gains and other side information directly into the transcoding coefficients (TCs) which are applied to the downmix signal to create the corresponding signals for the rendered output audio scene (or a preprocessed downmix signal for a further decoding operation, i.e. typically multi-channel MPEG Surround rendering).

It has been found that the subjectively perceived audio quality of the rendered output scene can be improved by application of distortion control measures or DCMs, as described in non-pre-published U.S. 61/173,456. This improvement can be achieved for the price of accepting a moderate dynamic modification of the target rendering settings. The modification of the rendering information has time and frequency variant nature which under specific circumstances may result in unnatural sound colorations and temporal fluctuation artifacts.

In an alternative to the distortion control measures (DCMs) described in reference [6], embodiments according to the present invention use a number of parameter limiting schemes which focus on the reduction of audio artifacts (sound colorations, temporal fluctuations, etc.) and at the same time preserving a natural sound quality.

The proposed parameter limiting scheme concepts described herein do not adjust rendering coefficients (RCs) based on a distortion measure calculated using sophisticated algorithms based on psychoacoustic models. Instead, the proposed parameter limiting scheme concepts show a low computational and structural complexity and are therefore attractive for integration into SAOC technology. Nevertheless, they can also be advantageously combined with the schemes described in reference [6] in order to achieve better overall output quality by complementing each other.

Within the overall SAOC system, the parameter limiting schemes can be incorporated into the SAOC decoder processing chain in two ways. For example, that parameter limiting scheme can be placed at the front-end for indirect (external) modification of the SAOC output by controlling the rendering coefficients (RCs) R, which is shown as alternative (a) in FIG. 4. Alternatively, the inherent transcoding coefficients (TCs) T are directly (internally) modified at the back-end of the SAOC decoder, before the coefficients are applied to the downmix signal to yield the output upmix channel signals, which is shown as the alternative (b) of FIG. 4.

4.2. Indirect Control

In the following, the concept of indirect control will be discussed in more detail.

The underlying hypothesis of the indirect control method considers a relationship between distortion level and deviations of the RCs from their object-averaged value. This is based on the observation that the more specific attenuation/boosting is applied by the RCs to a particular object with respect to the other objects, the more aggressive modification of the transmitted downmix signal is to be performed by the SAOC decoder/transcoder. In other words: the higher the deviation of the "object gain" values are relative to each other, the higher the chance for unacceptable distortion to occur (assuming identical downmix coefficients). It has been found that this can be tested by examining the deviation of the RCs from the average of the RCs across all objects (e.g. mean rendering value).

Without loss of generality, the subsequent description is based on the configuration considering a mono downmix with unity downmix gains for all objects. For the case of nontrivial downmixes (with different and/or dynamic object gains) the algorithm can be appropriately modified. In addition, the RCs are assumed to be frequency invariant to simplify the notation.

Based on the user specified rendering scenario represented by the coefficients R(i) with object index i, the PLS prevents extreme rendering values by producing modified RC values $\tilde{R}(i)$ that are actually used by the SAOC rendering engine. They can be derived as the following function $$\tilde{R}(i)=F_R(R(i),\Lambda),$$

where $\Lambda$ is a PLS control parameter (i.e. threshold value). The PLS control parameter may be considered as a tolerance parameter.

The deviation $R_d(i)$ of rendering coefficient R(i) from an averaged rendering value $\overline{R}$ (e.g. the arithmetic mean) can be obtained as $$R_d(i) = \frac{R(i)}{\overline{R}}, \text{ where } \overline{R} = \frac{1}{N_{ob}}\sum_{i=1}^{N_{ob}} R(i).$$

Accordingly, $R_d(i)$ is a ratio between a rendering coefficient R(i) and an averaged rendering value $\overline{R}$. The averaged rendering value $\overline{R}$ is an average value, averaged over the audio objects having audio object indices i, of the rendering coefficients R(i).

The limited deviation $\tilde{R}_d(i)$ is restricted to a certain tolerance $\Lambda$ range as $$\tilde{R}_d(i) = \Lambda \text{ for } R_d(i) > \Lambda,$$

$$\tilde{R}_d(i) = \frac{1}{\Lambda} \text{ for } R_d(i) < \frac{1}{\Lambda}.$$

Note that this corresponds to an RC limiting operation which is carried out relative to a reference value, for example $\overline{R}$ which is computed dynamically from the input RCs rather than a specific pre-defined value.

For the described PLS approach the optimal solution can be formulated as a minimization problem for which the difference between given RC R(i) and modified (limited) $\tilde{R}(i)$ value is minimized $$\|\tilde{R}(i)-R(i)\|\rightarrow\min.$$

In the following, some algorithmic solutions for providing the adjusted rendering coefficients $\tilde{R}(i)$ will be described, wherein the adjusted rendering coefficients $\tilde{R}(i)$ can be considered as adjusted parameters.

The following two algorithmic solutions are based on the deviation of those rendering values which lie outside the tolerance range, i.e.

$$R_{d,out}(i) = R_d(i) \text{ for } R_d(i) > \Lambda, \text{ or } R_d(i) < \frac{1}{\Lambda}.$$

4.2.1 One-Step Solution

A simple and fast one-step solution can be employed to limit all rendering values outside the tolerance range by $$\tilde{R}(i) = \Lambda\overline{R} \text{ for } R_{d,out}(i) > \Lambda,$$

$$\tilde{R}(i) = \frac{\overline{R}}{\Lambda} \text{ for } R_{d,out}(i) < \frac{1}{\Lambda}.$$

In contrast, the rendering values inside the tolerance range may be left unaffected, such that $$\tilde{R}(i)=R(i)$$

for such rendering values $\tilde{R}(i)$.

4.2.2 Iterative Solution

Another straightforward method can be employed in which the out-of-range rendering values with associated deviations $R_{d,out}(i)$ are limited gradually. In each iteration of this algorithm, the maximal rendering deviation $R_{d,max}$ is defined as $$R_{d,max} = \max\{R_{d,out}(i)\} \text{ for } R_d > \Lambda,$$

$$R_{d,max} = \min\{R_{d,out}(i)\} \text{ for } R_d < \frac{1}{\Lambda}.$$

The corresponding rendering coefficient is restricted such that $$\tilde{R}(i)=(1-\lambda)R(i)+\lambda R,\ \lambda\in(0,1).$$

This processing can be performed until all values are inside the tolerance region or with a pre-determined number of iterations.

Accordingly, in each iteration, a rendering coefficient $R(i_{max})$ is selected for which the deviation $R_{d,out}(i_{max})$ (for example, from the average value $\overline{R}$) takes the maximum value $R_{d,max}$. In other words, the rendering coefficient $R(i_{max})$ is selected, which comprises a maximum deviation (in terms of the deviation value $R_{d,out}$) from the average $\overline{R}$ over the rendering coefficients in the respective iteration. In addition, the selected rendering coefficient $R(i_{max})$ is brought closer to the average over the rendering coefficients using the above mentioned linear combination of R(i) and $\overline{R}$ (which may be applied selectively for $i=i_{max}$). In each step of the iterative procedure, a new selection of the rendering coefficient having the maximum deviation from the average value may be performed, such that different rendering coefficients may be modified in different steps of the iterative algorithm. In other words, $i_{max}$ is typically updated in every iteration. Also, the average value may optionally be recomputed for every step of the iterative algorithm, considering a previously modified rendering coefficient.

4.3 Direct Control

The underlying hypothesis of the direct control method considers a relationship between distortion level and deviations of the TCs from their time-averaged value. This is based on the observation that the more specific attenuation/boosting is applied to a particular object with respect to the other objects, the more aggressive modification of the transmitted downmix signal by the TCs is to be performed by the SAOC decoder/transcoder. In other words: if the value of a TC is unusually large, it can be concluded that the SAOC algorithm attempts to modify an object signal with small power into an output dominated by other object signal(s) with a large power by applying a strong boost. Conversely, if a TC is unusually small, it can be concluded that the SAOC algorithm attempts to modify an object signal with large power into an output dominated by other object signal(s) with a small power by applying a strong attenuation. In both cases, there is a high risk of producing an unacceptably low signal quality at the SAOC output. Thus, the central idea is to prevent large deviations of TCs from an average value.

This PLS can be considered as time and frequency variant, since it includes all dependencies on the SAOC signal parameters (e.g. OLD, IOC) and heuristic elements of the transcoding/decoding process.

Without loss of generality, the subsequent description is based on the configuration considering a mono upmix.

Based on the SAOC output TC T(k) with frequency index k, the PLS prevents extreme values of the TCs by replacing them (e.g., transcoding coefficients outside of a tolerance interval) with modified TC values which are then used by the actual SAOC rendering process. The modified TC values $\tilde{T}(k)$ can be derived with the following function $$\tilde{T}(k)=F_T(T(k),\Lambda),$$

where $\Lambda$ is a PLS control parameter (i.e. threshold value). The PLS control parameter may be considered as a tolerance parameter.

Since the TCs are time-variant, a recursive low pass filter is applied to calculate the mean $$\overline{T}_n(k)=\mu T_n(k)+(1-\mu)\overline{T}_{n-1}(k).$$

The mean $\overline{T}$ is considered as an average value, wherein a weighting of the individual transcoding values is introduced by the application of the recursive low pass filtering.

Here, n represents the time index of TCs and $\mu\epsilon(0,1]$ is the averaging parameter. The tolerance range for the modified TC value $\tilde{T}(k)$ is defined as $$\frac{\overline{T}(k)}{\Lambda} \le \tilde{T}(k) \le \Lambda\overline{T}(k).$$

Note that this corresponds to a TC limiting operation which is carried out relative to a reference value which is computed dynamically from the TCs rather than a specific pre-defined value.

For the described PLS approach the optimal solution can be formulated as minimization problem for which the difference between given TC T(k) and modified (limited) TC $\tilde{T}(k)$ value is minimized $$\|\tilde{T}(k)-T(k)\|\rightarrow\min.$$

In the following, a possible solution algorithm for this problem will be described.

4.3.1 Solution Algorithm

The modified TC value $\tilde{T}(k)$ can be obtained as $$\tilde{T}(k) = \Lambda\overline{T}(k) \text{ for } T(k) > \Lambda,$$

$$\tilde{T}(k) = \frac{\overline{T}(k)}{\Lambda} \text{ for } T(k) < \frac{1}{\Lambda}.$$

4.3.2 Examples of Transcoding Coefficients

The above discussed parameter limiting scheme for transcoding coefficients can be applied to different transcoding coefficients which are used, for example, in the SAOC decoders and transcoders discussed above.

For example, the parameter limiting scheme for transcoding coefficients can be applied to limit parameters of the mix matrix G, which is used in the signal processor 330 of the apparatus 300. In this case, a mix matrix element at a given matrix position of the matrix G may take the place of a transcoding coefficient T(k), wherein k is a frequency index. A corresponding mix matrix element of the mix matrix G' may correspond to an adjusted transcoding coefficient $\tilde{T}(k)$. The transcoding parameter limiting scheme may be applied, for example, individually to the different matrix positions of the mix matrix. For example, if the mix matrix G comprises mix matrix elements $g_{11}$, $g_{12}$, $g_{21}$ and $g_{22}$, and the adjusted mix matrix G' comprises corresponding matrix elements $g_{11}'$, $g_{12}'$, $g_{21}'$ and $g_{22}'$, the adjusted mix matrix element $g_{11}'(n_0)$ may be derived from a sequence $g_{11}(1)$ to $g_{11}(n_0)$. Equivalent derivations may be used for the other mix matrix elements $g_{12}'$, $g_{21}'$ and $g_{22}'$ of the adjusted mix matrix G'.

The table of FIG. 10 provides a list of transcoding coefficients which can be modified, for example, limited, by the proposed parameter limiting schemes for all SAOC modes of operation. The table of FIG. 10 shows, in a first column 1010, different SAOC modes. The table of FIG. 10 further shows, in a second column 1020, which parameters can be modified (for example, limited) by the proposed parameter limiting scheme. A third column 1030 shows a reference to the corresponding subclauses of the MPEG SAOC FCD document of reference [8]. To summarize, the table of FIG. 10 shows a list of transcoding coefficients which can be modified (for example, limited) by the proposed parameter limiting schemes for all SAOC modes of operation with references to corresponding subclauses of the MPEG SAOC FCD document [8].

4.4 Generalized Formulation of the Parameter Limiting Scheme for Limited Relative Deviation There exists a generalized formulation for the above-discussed PLS. This formulation can be expressed in the form of the following minimization problem for the general parameter variable $\tilde{X}_i$ as $$\begin{cases} \frac{\overline{X}_i}{\Lambda} \le \tilde{X}_i \le \Lambda\overline{X}_i, \\ \|\tilde{X}_i - X_i\| \rightarrow \min. \end{cases}$$

Here, the value of $X_i$ is initially given and the "reference" value $\overline{X}_i$ can be estimated as a function of the modified $\tilde{X}_i$ variable as $\overline{X}_i=F(\tilde{X}_i)$.

In the above, the parameter variable $X_i$ may, for example, be identical to R(i) or T(i). Similarly, the adjusted parameter variable $\tilde{X}_i$ may be identical to the adjusted rendering coefficient $\tilde{R}(i)$ or the adjusted transcoding coefficient $\tilde{T}(i)$. The variables $X_i$, $\tilde{X}_i$ may also, for example, be equivalent to mix matrix elements $g_{mn}(i)$ and $g_{mn}'(i)$.

In the following, two solution algorithms will be discussed.

Generally, the analytical approaches for obtaining the exact solution of such minimization problems are computationally demanding. Nevertheless, there exist simple and fast alternative ways providing suboptimal results which are still suitable for the PLS purposes. Two such simple approaches are described here.

4.4.1 One-Step Solution

The one-step solution based on assumption that $\overline{X}_i \approx F(\tilde{X}_i)$ limits all values outside the tolerance range to lie inside it by $$\tilde{X}_i = \Lambda \overline{X}_i \text{ for } X_i > \Lambda,$$

$$\tilde{X}_i = \frac{\overline{X}_i}{\Lambda} \text{ for } X_i < \frac{1}{\Lambda}.$$

Values which lie inside the tolerance range (which may be considered as a tolerance interval) may, for example, be left unchanged.

4.4.2 Iterative Solution

The iterative solution modifies in each step one selected out-of-range value $X_{i*}$ to $\tilde{X}_{i*}$ $$\tilde{X}_{i*} = (1-\lambda)X_{i*} + \lambda \overline{X} \text{ with } \lambda \in (0,1).$$

For instance, the processing index i* can be chosen using the condition:

$$X_{i*} = \max\left(\frac{X_i}{\overline{X}}\right) \text{ and } \frac{X_i}{\overline{X}} > \Lambda, \text{ or}$$

$$X_{i*} = \min\left(\frac{X_i}{\overline{X}}\right) \text{ and } \frac{X_i}{\overline{X}} < \frac{1}{\Lambda}.$$

The number of iterations can be set to a certain value or implicitly derived from the algorithm.

One should note that all these methods can be applied for limiting RCs and TCs as described above 4.5 Generalized Linear Formulation There exists a generalized linear formulation for the above-discussed PLS. In the previous section the deviation of the general parameter $X_i$ is described as a ratio $$\frac{X_i}{\overline{X}}.$$

In contrast, it can also be defined as $\|X_i - \overline{X}_i\|$ leading to the following minimization problem for the general parameter variable $\tilde{X}_i$ as $$\begin{cases} (\overline{X}_i - \Lambda_{X^-}) \le \tilde{X}_i \le (\overline{X}_i + \Lambda_{X^+}). \\ \|\tilde{X}_i - X_i\| \to \min. \end{cases}$$

Here, the value of $X_i$ is initially given and the "reference" value $\overline{X}_i$ can be estimated as a function of the modified $\tilde{X}_i$ variable as $\overline{X}_i = F(\tilde{X}_i)$.

In the following, two solution algorithms for this problem will be described.

Generally, the analytical approaches for obtaining the exact solution of such minimization problems are generally computationally demanding. Nevertheless, there exist simple and fast alternative ways providing suboptimal results which are still suitable for the PLS purposes. Two such simple approaches are described here:

4.5.1 One-Step Solution

The one-step solution based on assumption that $\overline{X}_i \approx F(X_i)$ limits all values outside the tolerance range to lie inside it by $$\tilde{X}_i = \min(\max(X_i, \overline{X}_i - \Lambda_{X-}), \overline{X}_i + \Lambda_{X+}).$$

4.5.2 Iterative Solution

The iterative solution modifies in each step one selected value $X_{i*}$ to if $\tilde{X}_{i*}$ if $X_{i*}$ is outside a tolerance range:

$$X_{i*} > \overline{X}_{i*} \text{ and } \|X_{i*} - \overline{X}_{i*}\| > \|X_{i*} - \Lambda_{X+}\| \Rightarrow \tilde{X}_{i*} = X_{i*} - S,$$

$$X_{i*} < X_{i*} \text{ and } \|X_{i*} - \overline{X}_{i*}\| < \|X_{i*} - \Lambda_{X-}\| \Rightarrow \tilde{X}_{i*} = X_{i*} + S,$$

For instance, the processing index i* can be chosen using the condition: $\|X_{i*} - \overline{X}_{i*}\| \ge \|X_i - \overline{X}_i\|$ and the modification step size value as $S = \lambda \|X_{i*} - \overline{X}_{i*}\|$ with $\lambda \in (0,1)$. The number of iterations can be set to a certain value or implicitly derived from the algorithm.

This algorithm provides a flexible way of using the tolerance range, i.e. it is dynamically changing (depending on $X_{i*}$).

One should note that all these methods can be applied for limiting RCs and TCs as described above.

Alternatively, the following algorithm can be used:

If $X_{i*} > \overline{X}_{i*}$ and $\|X_{i*} - \overline{X}_{i*}\| > \Lambda_{X+}$ then $\tilde{X}_{i*} = X_{i*} - S$ and if $X_{i*} < \overline{X}_{i*}$ and $\|X_{i*} - \overline{X}_{i*}\| > \Lambda_{X-}$ then $\tilde{X}_{i*} = X_{i*} + S.$ This version of the algorithm uses a fix (static) tolerance range $\Lambda_{X-}$, $\Lambda_{X+}$.

4.6 Further Remarks

One should note that all these methods can be applied for limiting rendering coefficients and transcoding coefficients, as described above.

5. Application of Parameter Limiting Schemes to Multichannel Downmix/Upmix Scenarios The single TC PLS (e.g. direct control) of a mono downmix/mono upmix scenario extends to a TC matrix considering any combination of downmix/upmix channels. Consequently, the direct control can be applied to each TC individually. The multichannel upmix scenario for the RC PLS (e.g. indirect control) can be realized, for instance, in a simple multiple-mono approach where all individual rendering coefficients are handled independently.

6. Listening Test Results 6.1 Test Design and Items

The subjective listening test has been conducted to assess the perceptual performance of the proposed distortion control measure (DCM) concepts and compare it to the regular SAOC reference model (SAOC RM) decoding processing.

The test design includes the cases of individual application of the direct and indirect control approaches of the proposed parameter limiting scheme as well as their combination. The output signal of the regular (unprocessed by the parameter limiting scheme PLS) SAOC decoder is included in the test to demonstrate the baseline performance of the SAOC. In addition, the case of trivial rendering, which corresponds to the downmix signal, is used in the listening test for comparison purposes.

The table of FIG. 5*a* describes listening test conditions.

The four items representing typical and most critical artifact types for the extreme rendering conditions have been chosen for the current listening test from the call-for-proposals (CfP) listening test material.

The table of FIG. 5*b* describes audio items of the listening test.

The rendering object gains according to the table of FIG. 6 have been applied for the considered upmix scenarios.

Since the proposed PLS operates using the regular SAOC bitstreams and downmixes (no any PLS related activity on SAOC encoder side is needed) and does not relay on residual information, no core coder has been applied to the corresponding SAOC downmix signals.

For all test items and considered rendering conditions the global settings for the PLS are taken as $$\Lambda_{\{R-,R+\}}=\Lambda_{\{T-,T+\}}=6$$

6.2 Test Methodology

The subjective listening tests were conducted in an acoustically isolated listening room that is designed to permit high-quality listening. The playback was done using headphones (STAX SR Lambda Pro with Lake-People D/A-Converter and STAX SRM-Monitor).

The test method followed the procedure used in the spatial audio verification tests, based on the "Multiple Stimulus with Hidden Reference and Anchors" (MUSHRA) method for the subjective assessment of intermediate quality audio [7]. The test method has been accordantly modified in order to assess the perceptual performance of the proposed DCM concepts. In accordance with the adopted test methodology, the listeners were instructed to compare all test conditions against each other according to the following listening test instructions:

For each audio item please:

first read the description of the desired sound mixes that you as a system user would like to achieve:

Item "BlackCoffee": Soft horn section sound within the sound mix

Item "Fanta4": Strong drum sound within the sound mix

Item "LovePop": Soft string section sound within the sound mix

Item "Audition": Soft music and strong vocal sound then grade the signals using one common grade to describe both achieving the objective of the desired sound mix overall scene sound quality (consider distortions, artifacts, unnaturalness . . . )

A total of 9 listeners participated in each of the performed tests. All subjects can be considered as experienced listeners. The test conditions were randomized automatically for each test item and for each listener. The subjective responses were recorded by a computer-based MUSHRA program on a scale ranging from 0 to 100. An instantaneous switching between the items under test was allowed.

6.3 Listening Test Results

A short overview in terms of the diagrams demonstrating the obtained listening test results can be found in the appendix. These plots show the average MUSHRA grading per item over all listeners and the statistical mean value over all evaluated items together with the associated 95% confidence intervals.

The following observations can be made based upon the results of the conducted listening tests: For all conducted listening tests the obtained MUSHRA scores prove that the proposed PLS functionality provides better performance in comparison with the regular SAOC RM system in sense of overall statistical mean values. One should note that the quality of all items produced by the regular SAOC decoder (showing strong audio artifacts for the considered extreme rendering conditions) is graded just slightly higher in comparison to the quality of downmix-identical rendering settings which does not fulfill the desired rendering scenario at all. Hence, it can be concluded that the proposed PLS lead to considerable improvement of subjective signal quality for all considered listening test scenarios. It can be also concluded that the most promising limiting system consists of a combination of both RC and TC PLS.

Figure 7:
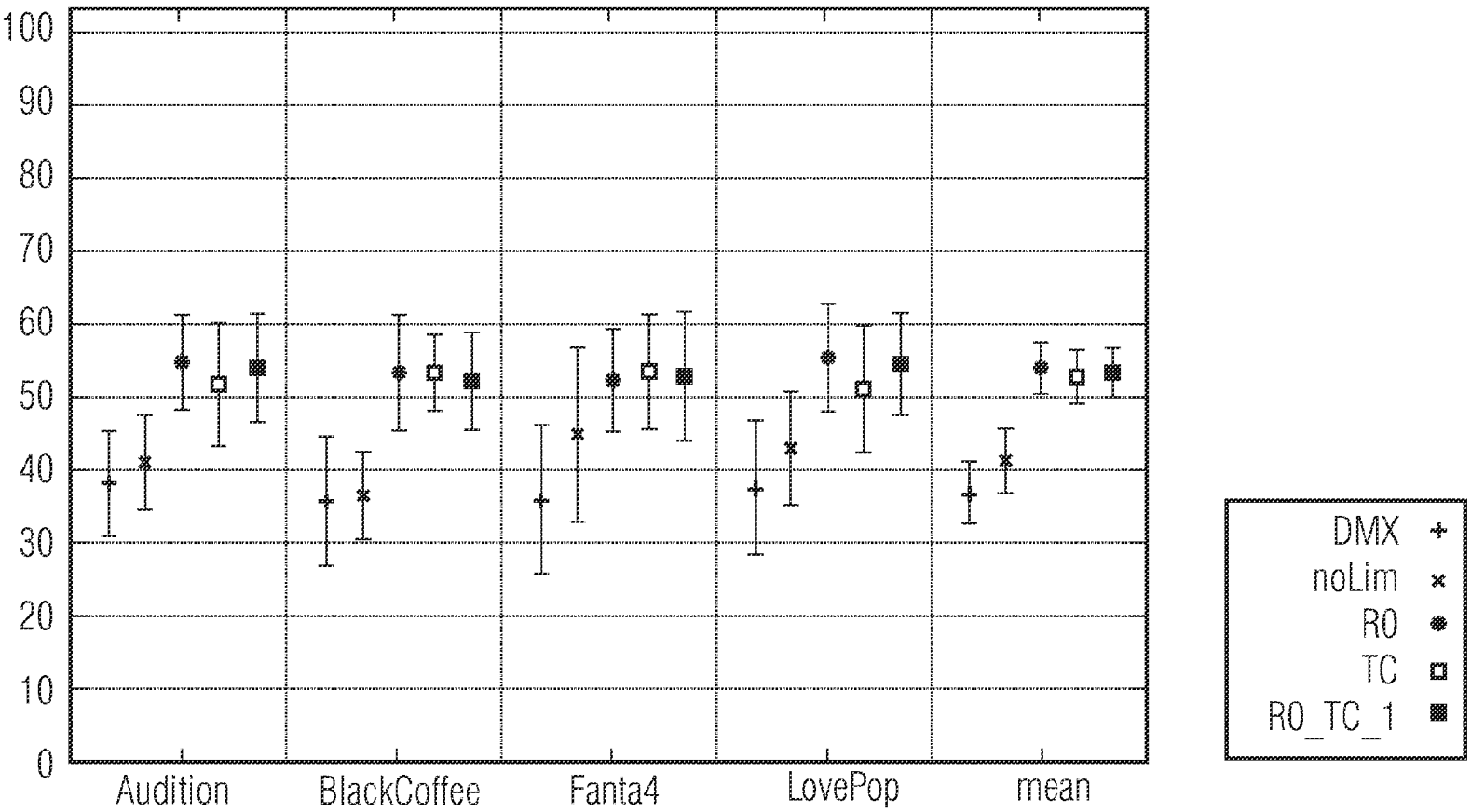
FIG. 7 shows a graphical representation of MUSHRA listening test results for different parameter limiting schemes (PLS)
Figure 8:
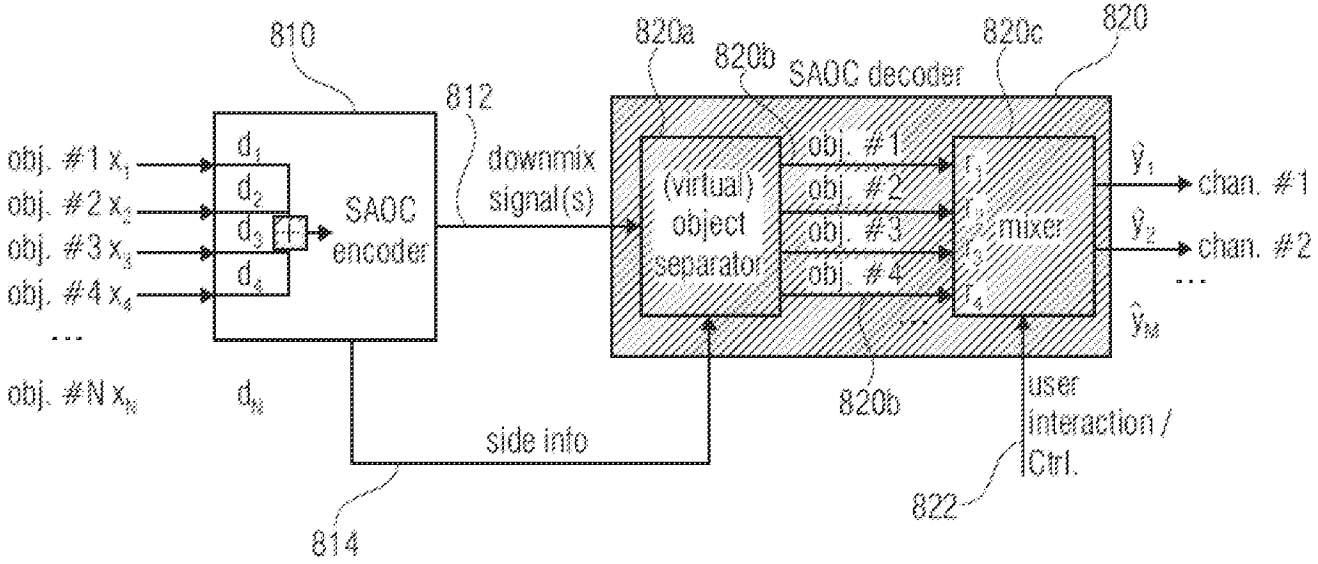
FIG 8 PRIOR ART
FIG. 8 shows a block schematic diagram of a reference MPEG SAOC system.
Figure 9A:
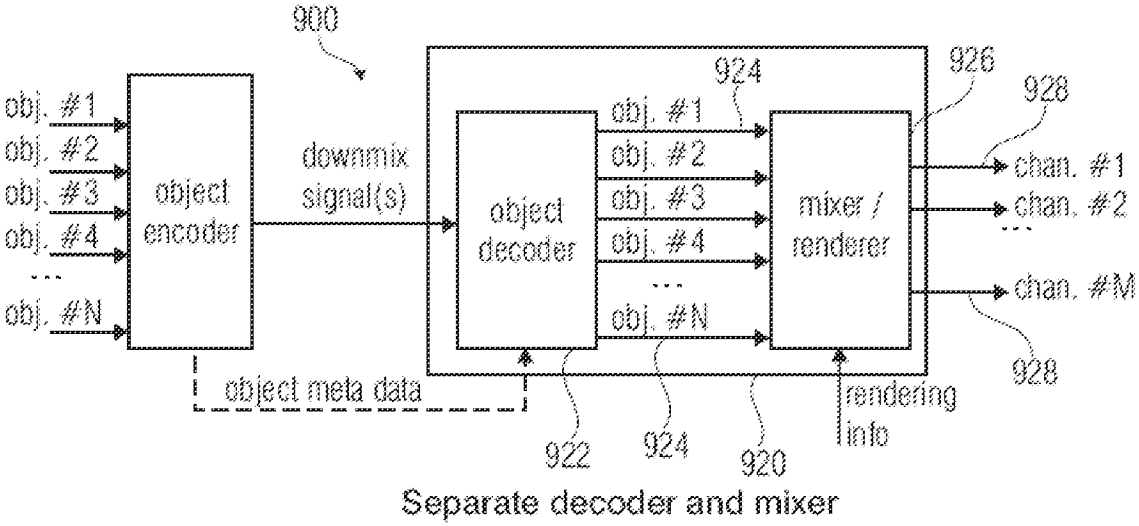
FIG 9A PRIOR ART
FIG. 9*a* shows a block schematic diagram of a reference SAOC system using a separate decoder and mixer.
Figure 9B:
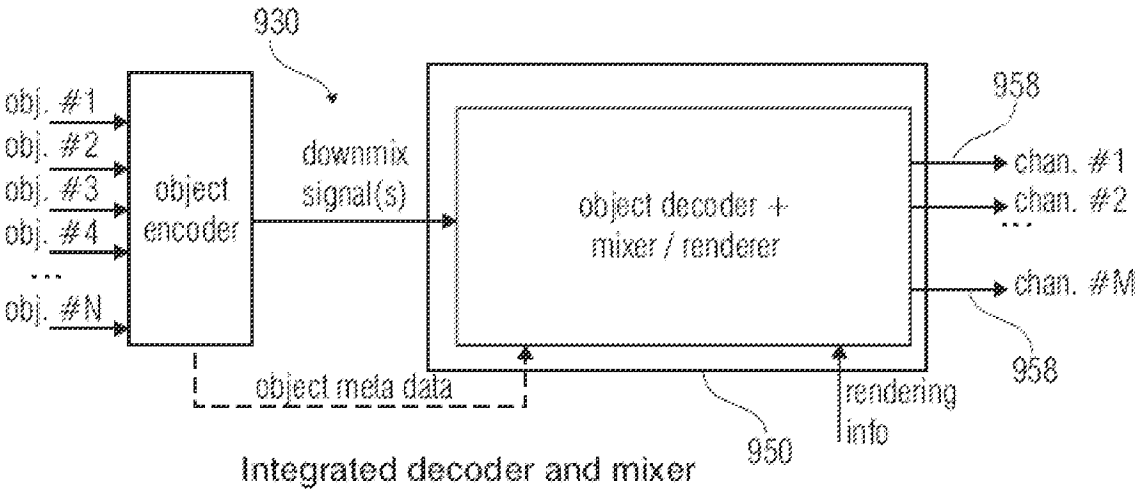
FIG 9B PRIOR ART
FIG. 9*b* shows a block schematic diagram of a reference SAOC system using an integrated decoder and mixer.
Figure 9C:
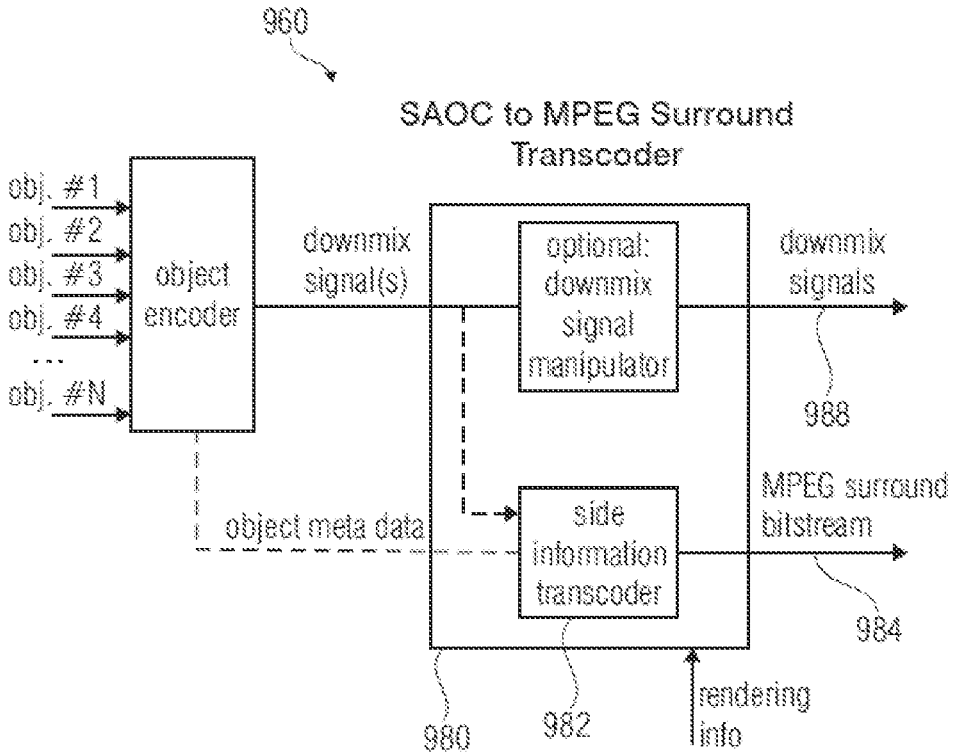
FIG 9C PRIOR ART
FIG. 9*c* shows a block schematic diagram of a reference SAOC system using an SAOC-to-MPEG transcoder.

Details regarding the listening test results can be seen in the graphic representation of FIG. 7.

7. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

8. Conclusions

Embodiments according to the invention create parameter limiting schemes for distortion control in audio decoders. Some embodiments according to the invention are focused on spatial audio object coding (SAOC), which provides means for a user interface for a selection of the desired playback setup (for example, mono, stereo, 5.1, etc.) and interactive real-time modification of the desired output rendering scene by controlling the rendering matrix according to a personal preference or other criteria. However, it is a straightforward task to adapt the proposed method for parametric techniques in general.

Due to the downmix/separation/mix-based parametric approach, the subjective quality of the rendered audio output depends on the rendering parameter settings. The freedom of selecting rendering settings of the users choice entails the risk of the user selecting inappropriate object rendering options, such as extreme gain manipulations of an object within the overall sound scene.

For a commercial product it is by all means unacceptable to produce bad sound quality and/or audio artifacts for any settings on the user interface. In order to control excessive deterioration of the produced SAOC audio output, several computational measures have been described which are based on the idea of computing a measure of perceptual quality of the rendered scene, and depending on this measure (and other information), modify the actually applied rendering coefficients (see, for example, reference [6]).

The present invention creates alternative ideas for safeguarding the subjective sound quality of the rendered SAOC scene

- for which all processing is carried out entirely within the SAOC decoder/transcoder, and
- which do not involve the explicit calculation of sophisticated measures of perceived audio quality of the rendered sound scene.

These ideas can thus be implemented in a structurally simple and extremely efficient way within the SAOC decoder/transcoder framework. Since the proposed distortion control mechanisms (DCMs) aim at limiting parameters inherent to the SAOC decoder, namely, the rendering coefficients (RCs) and the transcoding coefficients (TCs), they are called parameter limiting schemes (PLS) throughout the present description.

However, the parameter limiting schemes can be applied to any different audio decoders as well.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

9. References

[1] C. Faller and F. Baumgarte, "*Binaural Cue Coding—Part II: Schemes and applications*", IEEE Trans. on Speech and Audio Proc., vol. 11, no. 6, November 2003.

[2] C. Faller, "*Parametric Joint-Coding of Audio Sources*", 120th AES Convention, Paris, 2006, Preprint 6752.

[3] J. Herre, S. Disch, J. Hilpert, O. Hellmuth: "*From SAC To SAOC—Recent Developments in Parametric Coding of Spatial Audio*", 22nd Regional UK AES Conference, Cambridge, UK, April 2007.

[4] J. Engdegård, B. Resch, C. Falch, O. Hellmuth, J. Hilpert, A. Hölzer, L. Terentiev, J. Breebaart, J. Koppens, E. Schuijers and W. Oomen: "*Spatial Audio Object Coding (SAOC)—The Upcoming MPEG Standard on Parametric Object Based Audio Coding*", 124th AES Convention, Amsterdam 2008, Preprint 7377.

[5] ISO/IEC, "MPEG audio technologies—Part 2: Spatial Audio Object Coding (SAOC)," ISO/IEC JTC1/SC29/WG11 (MPEG) FCD 23003-2.

[6] U.S. patent application 61/173,456, METHODS, APPARATUS, AND COMPUTER PROGRAMS FOR DISTORTION AVOIDING AUDIO SIGNAL PROCESSING

[7] EBU Technical recommendation: "*MUSHRA-EBU Method for Subjective Listening Tests of Intermediate Audio Quality*", Doc. B/AIM022, October 1999.

[8] ISO/IEC JTC1/SC29/WG11 (MPEG), Document N10843, "*Study on ISO/IEC* 23003-2:200*x Spatial Audio Object Coding* (*SAOC*)", 89th MPEG Meeting, London, UK, July 2009

The invention claimed is:

1. An apparatus for providing one or more adjusted parameters for a provision of an upmix signal representation on the basis of a downmix signal representation and a parametric side information associated with the downmix signal representation, the apparatus comprising:

a parameter adjuster configured to receive a plurality of parameters and to provide, on the basis thereof, one or more adjusted parameters, wherein the parameter adjuster is configured to provide the one or more adjusted parameters in dependence on an average value of the plurality of parameters, such that a distortion of the upmix signal representation caused by the use of non-optimal parameters for the provision of the upmix signal representation is reduced at least for one or more of the plurality of parameters deviating from optimal parameters by more than a predetermined deviation.

2. The apparatus according to claim 1, wherein the parameter adjuster is configured to provide the one or more adjusted parameters in dependence on an average value which is a weighted average of the plurality of parameters.

3. The apparatus according to claim 1, wherein the parameter adjuster is configured to provide the one or more adjusted parameters such that the one or more adjusted parameters deviate from the average value less than corresponding received parameters.

4. The apparatus according to claim 1, wherein the apparatus is configured to receive a plurality of rendering coefficients describing desired contributions of audio objects to one or more channels of the upmix signal representation, and wherein the apparatus is configured to provide one or more adjusted rendering coefficients as the adjusted parameters.

5. The apparatus according to claim 4, wherein the parameter adjuster is configured to receive, as input parameters, a plurality of rendering coefficients; and wherein the parameter adjuster is configured to compute an average over rendering coefficients associated with a plurality of audio objects; and wherein the parameter adjuster is configured to provide the adjusted rendering coefficients such that a deviation of an adjusted rendering coefficient from the average over rendering coefficients associated with the plurality of audio objects is restricted.

6. The apparatus according to claim 5, wherein the parameter adjuster is configured to leave a rendering coefficient, which is within a tolerance interval determined in dependence on the average over the rendering coefficients, unchanged, and to selectively set a rendering coefficient, which is larger than an upper boundary value of the tolerance interval, to a value which is smaller than or equal to the upper boundary value, and to selectively set a rendering coefficient, which is smaller than a lower boundary value of the tolerance interval to a value which is larger than or equal to the lower boundary value.

7. The apparatus according to claim 5, wherein the parameter adjuster is configured to iteratively select a respective one of the rendering coefficients, which comprises a maximum deviation from the average over the rendering coefficients in the respective iteration, and bring the selected one of the rendering coefficients closer to the average over the rendering coefficients, in order to iteratively bring rendering coefficients, which are outside of a tolerance interval determined in dependence on the average over the rendering coefficients, into the tolerance interval.

8. The apparatus according to claim 7, wherein the parameter adjuster is configured to repeat the iterative selection of a respective one of the rendering coefficients and the iterative modification of the selected one of the rendering coefficients until all rendering coefficients are adjusted to be within applicable tolerance intervals.

9. The apparatus according to claim 1, wherein the apparatus is configured to receive one or more transcoding coefficients describing a mapping of one or more channels of the downmix signal representation onto one or more channels of the upmix signal representation, and wherein the apparatus is configured to provide one or more adjusted transcoding coefficients as the adjusted parameters.

10. The apparatus according to claim 9, wherein the parameter adjuster is configured to receive, as input parameters, a temporal sequence of transcoding coefficients; and wherein the parameter adjuster is configured to compute a temporal mean in dependence on a plurality of transcoding coefficients; and wherein the parameter adjuster is configured to provide the adjusted transcoding coefficients such that a deviation of the adjusted transcoding coefficients from the temporal mean is restricted.

11. The apparatus according to claim 10, wherein the parameter adjuster is configured to leave a transcoding coefficient, which is within a tolerance interval determined in dependence on the temporal mean, unchanged, and to selectively set a transcoding coefficient, which is larger than an upper boundary value of the tolerance interval, to a value which is smaller than or equal to the upper boundary value of the tolerance interval, and to selectively set a transcoding coefficient, which is smaller than a lower boundary value of the tolerance interval, to a value which is larger than or equal to the lower boundary value.

12. The apparatus according to claim 10, wherein the parameter adjuster is configured to calculate the temporal mean using a recursive low pass filtering of the sequence of transcoding coefficients.

13. The apparatus according to claim 1, wherein the parameter adjuster is configured to provide a given one of the one or more adjusted parameters such that the given one of the adjusted parameters is within a tolerance interval, boundaries of which are defined in dependence on the average value of a plurality of input parameters and one or more tolerance parameters, and such that a deviation between an input parameter and a corresponding adjusted parameter is minimized or kept within a predetermined maximal allowable range.

14. The apparatus according to claim 13, wherein the parameter adjuster is configured to selectively set an input parameter, which is found to be outside of the tolerance interval, the boundaries of which are defined in dependence on the average value of the plurality of input parameters, to an upper boundary value or a lower boundary value of the tolerance interval, in order to acquire an adjusted version of the input parameter.

15. The apparatus according to claim 13, wherein the parameter adjuster is configured to iteratively select a respective one of the plurality of input parameters, which comprises a maximum deviation from the average value in a respective iteration, and to bring the selected one of the plurality of input parameters closer to the average, in order to iteratively bring input parameters, which are determined to be outside of the tolerance interval, the boundaries of which are defined in dependence on the average value, into the tolerance interval.

16. The apparatus according to claim 15, wherein the parameter adjuster is configured to choose a modification step size used to bring the selected one of the input parameters closer to the average value to be a predetermined fraction of a difference between the selected one of the plurality of input parameters and the average value.

17. An apparatus for providing an upmix signal representation on the basis of a downmix signal representation and a parametric side information, the apparatus comprising:

an apparatus for providing one or more adjusted parameters on the basis of a plurality of received parameters, for a provision of the upmix signal representation on the basis of the downmix signal representation and the parametric side information associated with the downmix signal representation, the apparatus comprising:

a parameter adjuster configured to receive a plurality of parameters and to provide, on the basis thereof, one or more adjusted parameters, wherein the parameter adjuster is configured to provide the one or more adjusted parameters in dependence on an average value of the plurality of parameters, such that a distortion of the upmix signal representation caused by the use of non-optimal parameters for the provision of the upmix signal representation is reduced at least for one or more of the plurality of parameters deviating from optimal parameters by more than a predetermined deviation;

a signal processor configured to acquire the upmix signal representation on the basis of the downmix signal representation and the parametric side information, wherein the apparatus for providing one or more adjusted parameters is configured to adjust one or more processing parameters of the signal processor.

18. The apparatus according to claim 17, wherein the signal processor is configured to provide the upmix signal representation in dependence on adjusted rendering coefficients describing contributions of audio objects to one or more channels of the upmix signal representation; and wherein the apparatus for providing one or more adjusted parameters is configured to receive a plurality of user-specified rendering parameters as input parameters and to provide, on the basis thereof, one or more adjusted rendering parameters for use by the signal processor.

19. The apparatus according to claim 17, wherein the apparatus for providing the one or more adjusted parameters is configured to receive one or more mix matrix elements of a mix matrix as the one or more input parameters, and to provide, on the basis thereof, one or more adjusted mix matrix elements of the mix matrix for use by the signal processor; and wherein the signal processor is configured to provide the upmix signal representation in dependence on the adjusted mix matrix elements of the mix matrix, wherein the mix matrix describes a mapping of one or more audio channel signals of the downmix signal representation onto one or more audio channel signals of the upmix signal representation.

20. The apparatus according to claim 17, wherein the signal processor is configured to acquire an MPEG surround arbitrary-downmix-gain value, and when the apparatus for providing one or more adjusted parameters is configured to receive a plurality of arbitrary-downmix-gain values as input parameters and to provide a plurality of adjusted arbitrary-downmix-gain values.

21. A method for providing one or more adjusted parameters for the provision of an upmix signal representation on the basis of a downmix signal representation and a parametric side information associated with the downmix signal representation, the method comprising:

receiving a plurality of parameters; and providing, on the basis thereof, one or more adjusted parameters, wherein the one or more adjusted parameters are provided in dependence on an average value of the plurality of parameters, such that a distortion of the upmix signal representation caused by the use of non-optimal parameters is reduced at least for one or more of the plurality of parameters deviating from optimal parameters by more than a predetermined deviation.

22. A non-transitory computer readable medium including a computer program for performing, when the computer program runs on a computer, a method for providing one or more adjusted parameters for the provision of an upmix signal representation on the basis of a downmix signal representation and a parametric side information associated with the downmix signal representation, the method comprising:

receiving a plurality of parameters; and providing, on the basis thereof, one or more adjusted parameters, wherein the one or more adjusted parameters are provided in dependence on an average value of the plurality of parameters, such that a distortion of the upmix signal representation caused by the use of non-optimal parameters is reduced at least for one or more of the plurality of parameters deviating from optimal parameters by more than a predetermined deviation.

* * * * *